US011362415B2

(12) United States Patent
Bongard et al.

(10) Patent No.: US 11,362,415 B2
(45) Date of Patent: Jun. 14, 2022

(54) RADIO-FREQUENCY SEAL AT INTERFACE OF WAVEGUIDE BLOCKS

(71) Applicant: Viasat Inc., Carlsbad, CA (US)

(72) Inventors: Frederic Bongard, Pully (CH); Xavier Aubry, Lausanne (CH); Martin Gimersky, Lausanne (CH)

(73) Assignee: Viasat, Inc., Carlsbad, CA (US)

( * ) Notice: Subject to any disclaimer, the term of this patent is extended or adjusted under 35 U.S.C. 154(b) by 0 days.

(21) Appl. No.: 17/186,639

(22) Filed: Feb. 26, 2021

(65) Prior Publication Data

US 2021/0184339 A1 Jun. 17, 2021

Related U.S. Application Data

(63) Continuation of application No. 16/489,829, filed as application No. PCT/US2018/023291 on Mar. 20, 2018, now Pat. No. 10,985,448.

(Continued)

(51) Int. Cl.
*H01Q 1/28* (2006.01)
*H01Q 5/55* (2015.01)

(Continued)

(52) U.S. Cl.
CPC ..... *H01Q 1/283* (2013.01); *H01P 1/173* (2013.01); *H01P 5/024* (2013.01); *H01P 5/182* (2013.01);

(Continued)

(58) Field of Classification Search
CPC ..... H01Q 1/28; H01Q 1/283; H01Q 3/08; H01Q 5/55; H01Q 13/06; H01Q 13/065;

(Continued)

(56) References Cited

U.S. PATENT DOCUMENTS 4,262,994 A 4/1981 Sheem
4,262,995 A 4/1981 Tangonan (Continued)

FOREIGN PATENT DOCUMENTS

CN 101667681 A1 3/2010
WO WO 2012/123473 A1 9/2012
WO WO 2017/137224 A1 8/2017

OTHER PUBLICATIONS

Aljarosha, et al. "Millimeter-Wave Microstrip-to-Groove Gap Waveguide Transition for use in Gap-Waveguide-Integrated Grid Amplifiers and Antenna Arrays", Mar. 2016, Department of Signals and Systems, Chalmers University of Technology, Gothenburg, Sweden, 140 pgs.

(Continued)

*Primary Examiner* — Haissa Philogene
(74) *Attorney, Agent, or Firm* — Holland & Hart LLP

(57) ABSTRACT

The described features include a scalable waveguide architecture for a waveguide device. The waveguide device may be split into one or more waveguide blocks instead of manufacturing increasingly larger single-piece waveguide devices. Described techniques provide for a radio-frequency (RF) seal between such waveguide blocks that may facilitate greater manufacturing tolerances while maintaining an effective RF seal at the junction of the waveguide blocks. The described techniques include channels within one or more waveguide blocks opening to the dielectric gap between the waveguide blocks. The channels may, for each of multiple waveguides joined at the interface between waveguide blocks, be included in one or both waveguide blocks and may be in a single waveguide dimension relative to the multiple waveguides, or extend for more than one waveguide dimensions.

24 Claims, 10 Drawing Sheets

700

Related U.S. Application Data

(60) Provisional application No. 62/473,712, filed on Mar. 20, 2017.

(51) Int. Cl.

| | |
|---|---|
| ***H01P 1/17*** | (2006.01) |
| ***H01P 5/02*** | (2006.01) |
| ***H01P 5/18*** | (2006.01) |
| ***H01Q 3/08*** | (2006.01) |
| ***H01Q 13/06*** | (2006.01) |

(52) U.S. Cl.
CPC ..... *H01Q 3/08* (2013.01); *H01Q 5/55* (2015.01); *H01Q 13/065* (2013.01)

(58) Field of Classification Search
CPC ..... H01P 1/171; H01P 1/172; H01P 1/173; H01P 5/024; H01P 5/182
See application file for complete search history.

(56) References Cited

U.S. PATENT DOCUMENTS

| | | | | |
|---|---|---|---|---|
| 5,082,342 | A | 1/1992 | Wight et al. | |
| 5,781,087 | A | 7/1998 | Milroy et al. | |
| 5,808,528 | A | 9/1998 | Griffith et al. | |
| 6,788,848 | B2 | 9/2004 | Yoneda | |
| 6,885,257 | B2 | 4/2005 | Kroening | |
| 6,977,561 | B2 | 12/2005 | Freeman | |
| 7,048,449 | B2 | 5/2006 | Frojdh et al. | |
| 7,298,936 | B1 | 11/2007 | Wach et al. | |
| 7,479,842 | B2 | 1/2009 | Gaucher et al. | |
| 7,592,887 | B2 | 9/2009 | Chao et al. | |
| 7,994,881 | B2 | 8/2011 | Suzuki | |
| 8,358,185 | B2 | 1/2013 | Ohno et al. | |
| 9,257,735 | B2 | 2/2016 | Fakharzadeh et al. | |
| 9,379,446 | B1 | 6/2016 | Schuss et al. | |
| 9,640,847 | B2 * | 5/2017 | Jensen | H01P 1/173 |
| 9,859,597 | B2 | 1/2018 | Jensen et al. | |
| 10,096,904 | B2 | 10/2018 | Bongard et al. | |
| 10,985,448 | B2 * | 4/2021 | Bongard | H01P 5/02 |
| 2009/0206961 | A1 | 8/2009 | Fujita | |
| 2014/0091884 | A1 | 4/2014 | Flatters | |
| 2016/0028141 | A1 | 1/2016 | Shimizu et al. | |
| 2016/0204496 | A1 | 7/2016 | Hobden | |
| 2017/0007761 | A1 | 3/2017 | Bongard et al. | |
| 2021/0286142 | A1 * | 9/2021 | Leigh | G02B 6/3822 |

OTHER PUBLICATIONS

Hesler, et al., "Recommendations for Waveguide Interfaces to 1 THz", 18th International Symposium on Space Terahertz Technology, Jan. 2007, 4 pgs.

Buiculescu et al., "Choke Flange-like structure for direct connection of cascaded substrate integrated waveguide components" Electronic Letters, vol. 48, No. 21, Oct. 2012, 2 pgs.

International Search Report and Written Opinion, PCT/US18/023291, dated Sep. 29, 2018.

* cited by examiner 600-a 600-b

RADIO-FREQUENCY SEAL AT INTERFACE OF WAVEGUIDE BLOCKS

CROSS REFERENCES

The present application for patent is a continuation of U.S. patent application Ser. No. 16/489,829 by Bongard et al., entitled "Radio-Frequency Seal at Interface of Waveguide Blocks," filed Aug. 29, 2019, which is a national stage entry of PCT Application No. PCT/US2018/023291 by Bongard et al., entitled "Radio-Frequency Seal at Interface of Waveguide Blocks," filed Mar. 20, 2018, which claims priority to U.S. Provisional Application No. 62/473,712 by Bongard et al., entitled "Radio-Frequency Seal at Interface of Waveguide Blocks," filed Mar. 20, 2017, each of which is assigned to the assignee hereof, and each of which is expressly incorporated by reference herein, in its entirety.

BACKGROUND

Waveguide devices are commonly used in wireless communication systems. For example, antenna arrays including waveguide antenna elements can provide desirable performance for communication over long distances. Passive antenna arrays with waveguide feed networks are one of the most suited technologies for antenna arrays because of the low level of losses they exhibit. As the number of antenna elements increases, the waveguide feed networks become increasingly complex and space consuming. This can be problematic in many environments (e.g., avionics) where space and/or weight are at a premium. It may accordingly be desirable to more densely pack an antenna array with a greater density of waveguide feed networks. Densely packed waveguide feed networks may include densely packed waveguides each coupled with corresponding power dividers and combiners. While increasing the density of a waveguide feed network may provide an increased number of waveguides, the overall size of the waveguide feed networks may still continue to increase to accommodate more waveguides. Increasing the number of waveguides and density of the waveguide feed networks provides challenges in manufacturing due to the large overall size and densely packed waveguides.

SUMMARY

A waveguide device including a radio-frequency (RF) seal for a waveguide block interface is described. The waveguide device may include a first waveguide block including first sections of a plurality of waveguides. The first waveguide block may have a first face including first openings for the first sections of the plurality of waveguides and a plurality of first channels, where each of the plurality of first channels may be located at a first length along the first face from one of the first openings. In some cases, the first length may be one quarter-wavelength of the operational frequency of the plurality of waveguides. The plurality of first channels may extend into the first waveguide block a second length. In some cases, the second length is one quarter-wavelength of the operational frequency of the plurality of waveguides. The waveguide device may further include a second waveguide block including second sections of the plurality of waveguides. The second waveguide block may include a second face having second openings for the second sections of the plurality of waveguides. In some cases, the first openings for the first sections of the plurality of waveguides may define planes perpendicular to respective center axes of the plurality of waveguides. In some cases, at least one of the first or second waveguide blocks may include a plurality of polarizers, where the plurality of polarizers include an individual waveguide and first and second divided waveguides associated with first and second polarizations. Each of the plurality of waveguides may correspond to one of the first and second divided waveguides.

Upon coupling the first face of the first waveguide block with the second face of the second waveguide block, first portions of a plurality of first waveguide stubs may be formed by first portions of dielectric gaps between the first face and the second face extending for the first length. Further, second portions of the plurality of first waveguide stubs may be formed by the plurality of first channels. Corresponding lengths of the plurality of first waveguide stubs may be based at least in part on an operational frequency of the plurality of waveguides. In some cases, a first impedance of the plurality of first waveguide stubs to the plurality of waveguides at each of the first openings may be less than a wave impedance of the plurality of waveguides.

In some cases, the lengths of the plurality of first waveguide stubs may be one half-wavelength of the operational frequency of the plurality of waveguides. In some cases, the second waveguide block may include a plurality of second channels, where each of the plurality of second channels may be located at the first length along the second face from one of the second openings. The plurality of second channels may extend into the second waveguide block the second length. Upon coupling the first face of the first waveguide block with the second face of the second waveguide block, first portions of a plurality of second waveguide stubs may be formed by second portions of the dielectric gaps between the first face and the second face. The second portions of the dielectric gaps may be the first length along the second face, and second portions of the plurality of second waveguide stubs may be formed by the plurality of second channels. In some cases, second portions of the dielectric gaps may extend away from the first openings along the first face from junctions of the first portions of the dielectric gaps with openings of the plurality of first channels. In some cases, upon the coupling of the first face of the first waveguide block with the second face of the second waveguide block, the plurality of first channels may be located in a first direction along the first face and the plurality of second channels may be located in a second direction along the second face, where the first direction may in an opposite direction (e.g., an opposite E-plane direction) of the first openings from the second direction.

Further scope of the applicability of the described methods and apparatuses will become apparent from the following detailed description, claims, and drawings. The detailed description and specific examples are given by way of illustration only, since various changes and modifications within the scope of the description will become apparent to those skilled in the art.

BRIEF DESCRIPTION OF THE DRAWINGS

A further understanding of the nature and advantages of embodiments of the present disclosure may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1:
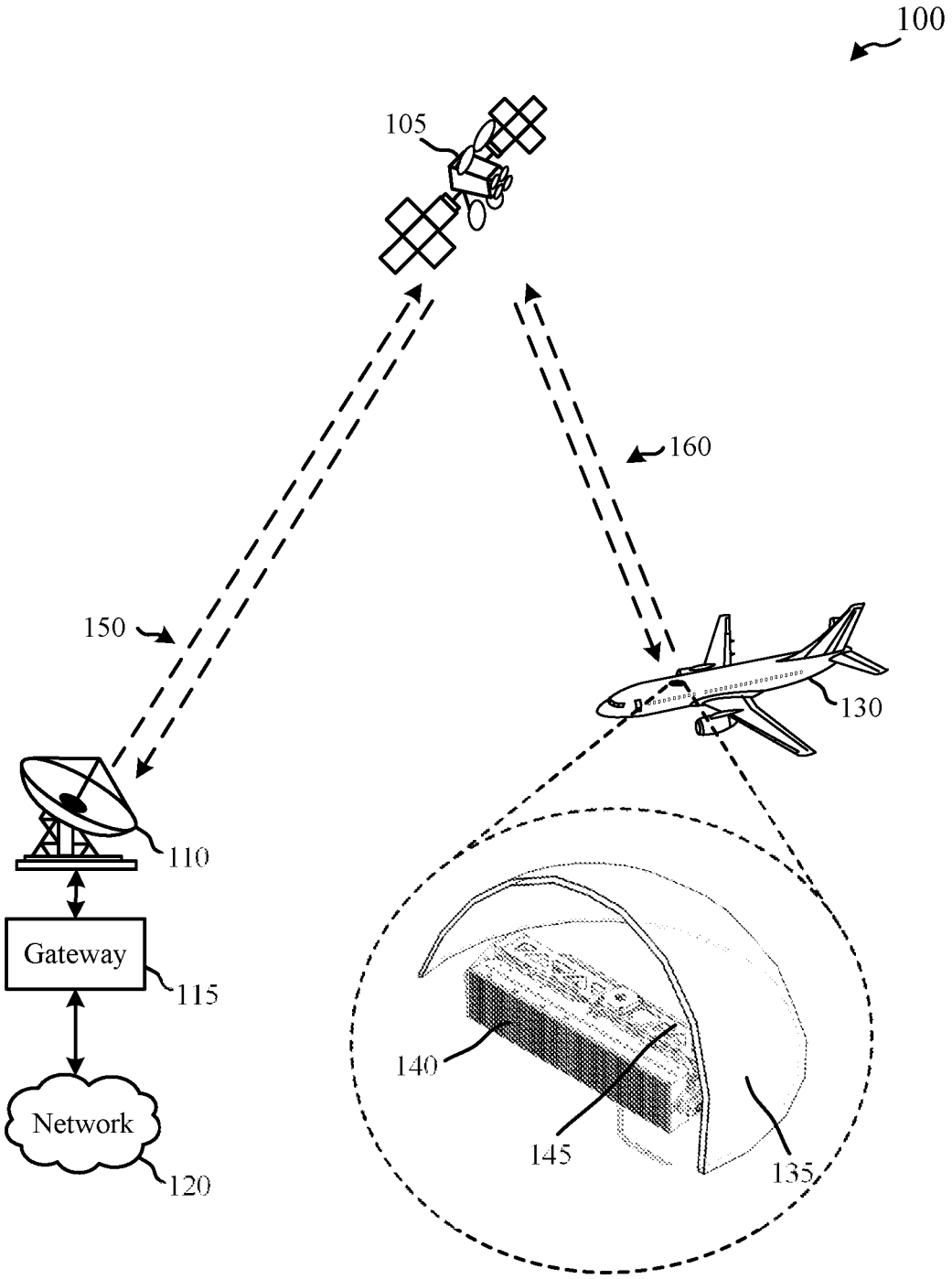
FIG. 1 shows a diagram of a satellite communication system in accordance with aspects of the present disclosure.

The described features generally relate to a waveguide device. The described features include a scalable waveguide architecture for waveguide devices using multiple waveguides. The described features may be employed in, for example, antenna arrays. Antenna arrays (which may be referred to herein as simply an "antenna") may include multiple antenna elements. In some cases, each antenna element includes a polarizer (e.g., a septum polarizer) having divided waveguide ports associated with each basis polarization. The antenna may include waveguide networks associated with each basis polarization connecting the divided waveguides of each antenna element to common waveguides associated with each basis polarization. The waveguide networks may include ridged waveguide components and/or non-ridged waveguide components. The inter-element distance between antenna elements may be selected to provide grating lobe free operation at the highest operating frequency. Thus, the inter-element distance may be small relative to the operating frequency range and consistent across a waveguide assembly of unit cells, minimizing grating lobes for the antenna.

To provide efficient operation across the operational frequency range, it may be desirable to feed a large number of antenna elements using continuous waveguide combiner/divider networks (e.g., with no changes in propagation medium). These waveguide combiner/divider networks may be complex and, for example, to increase a number of antenna elements and corresponding waveguide combiner/dividers, either a density of the antenna elements may be increased, or an overall size of the dual-polarized antenna may be increased to accommodate more antenna elements and waveguide combiner/dividers. To manufacture increasingly large waveguide networks, a waveguide network may be split into one or more waveguide blocks instead of manufacturing increasingly larger single-piece waveguide blocks. For example, the overall waveguide feed network may be manufactured as two or more waveguide blocks, where the waveguide blocks form a continuous waveguide signal path when joined. That is, the interface between the waveguide blocks may intersect one or more waveguides that would have otherwise been connected in a single-piece waveguide device. After coupling a first waveguide block with a second waveguide block, a first section of a waveguide of a first waveguide block may form a substantially continuous path with a second section of the waveguide of the second waveguide block. The techniques described herein may provide for a contactless radio-frequency (RF) seal between waveguide blocks that may facilitate greater manufacturing tolerances while maintaining an effective RF seal at the junction of the waveguide blocks.

This description provides examples, and is not intended to limit the scope, applicability or configuration of embodiments of the principles described herein. Rather, the ensuing description will provide those skilled in the art with an enabling description for implementing embodiments of the principles described herein. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, devices, and software may individually or collectively be components of a larger system, wherein other procedures may take precedence over or otherwise modify their application.

FIG. 1 shows a diagram of a satellite communication system 100 in accordance with aspects of the present disclosure. The satellite communication system 100 includes a satellite 105, a gateway 115, a gateway antenna system 110, and an aircraft 130. The gateway 115 communicates with one or more networks 120. In operation, the satellite communication system 100 provides for two-way communications between the aircraft 130 and the network 120 through the satellite 105 and the gateway 115.

The satellite 105 may be any suitable type of communication satellite. In some examples, the satellite 105 may be in a geosynchronous or geostationary earth orbit (GEO). In other examples, any appropriate orbit (e.g., low earth orbit (LEO), medium earth orbit (MEO), etc.) for satellite 105 may be used. The satellite 105 may be a multi-beam satellite configured to provide service for multiple service beam coverage areas in a predefined geographical service area. In some examples, the satellite communication system 100 includes multiple satellites 105.

The gateway antenna system 110 may be two-way capable and designed with adequate transmit power and receive sensitivity to communicate reliably with the satellite system 105. The satellite system 105 may communicate with the gateway antenna system 110 by sending and receiving signals through one or more beams 150. The gateway 115 sends and receives signals to and from the satellite system 105 using the gateway antenna system 110. The gateway 115 is connected to the one or more networks 120. The networks 120 may include a local area network (LAN), metropolitan area network (MAN), wide area network (WAN), or any other suitable public or private network and may be connected to other communications networks such as the Internet, telephony networks (e.g., Public Switched Telephone Network (PSTN), etc.), and the like.

The aircraft 130 includes an on-board communication system including antenna 140. The aircraft 130 may use the antenna 140 to communicate with the satellite 105 over one or more beams 160. The antenna 140 may be mounted on the outside of the fuselage of aircraft 130 under a radome 135. The antenna 140 may be mounted to a positioner 145 used to point the antenna 140 at the satellite 105 (e.g., actively tracking) during operation. The antenna 140 may be used for receiving communication signals from the satellite 105, transmitting communication signals to the satellite 105, or bi-directional communication with the satellite 105 (transmitting and receiving communication signals). The antenna 140 may operate in the International Telecommunications Union (ITU) Ku, K, or Ka-bands, for example from approximately 17 to 31 Giga-Hertz (GHz). Alternatively, the antenna 140 may operate in other frequency bands such as C-band, X-band, S-band, L-band, and the like.

The on-board communication system of the aircraft 130 may provide communication services for communication devices of the aircraft 130 via a modem (not shown). Communication devices may connect to and access the networks 120 through the modem. For example, mobile devices may communicate with one or more networks 120 via network connections to modem, which may be wired or wireless. A wireless connection may be, for example, of a wireless local area network (WLAN) technology such as the Institute of Electrical and Electronics Engineers (IEEE) 802.11 (Wi-Fi), or other wireless communication technology.

The size of the antenna 140 may directly impact the size of the radome 135, for which a low profile may be desired. In other examples, other types of housings are used with the antenna 140. Additionally, the antenna 140 may be used in other applications besides onboard the aircraft 130, such as onboard boats, vehicles, or on ground-based stationary systems.

For antennas using multiple waveguide elements for radiating and receiving energy, the operational frequency range of the antenna may be determined by the dimensions of each of the waveguide elements and the inter-element distance (distance from center-to-center of adjacent waveguide elements). For example, a cutoff frequency for each antenna element may be dependent on the cross-sectional dimensions of the waveguide element serving as a port between the antenna element and the transmission medium. Generally, as the operational frequency approaches the cutoff frequency, the efficiency of signal propagation in the waveguide decreases. To provide grating lobe free operation, the inter-element distance should be small relative to the desired operational frequency range (e.g., an inter-element distance less than or equal to one wavelength at the highest operating frequency for a non-electrically steered antenna, etc.). To provide efficient operation across the operational frequency range, it may be desirable to feed a large number of antenna elements using continuous waveguide combiner/divider networks (e.g., with no changes in propagation medium). These waveguide combiner/divider networks may be complex and, for example, to increase a number of antenna elements and corresponding waveguide combiner/dividers, either a density of the antenna elements may be increased, or an overall size of the dual-polarized antenna 140 may be increased to accommodate more antenna elements and waveguide combiner/dividers. To manufacture increasingly large waveguide networks, a waveguide network may be split into one or more waveguide blocks instead of manufacturing increasingly larger single-piece waveguide blocks. Techniques described herein may provide for RF sealing between such split waveguide blocks that may facilitate greater manufacturing tolerances while maintaining an effective RF seal at the junction of the split waveguide blocks.

Figure 2:
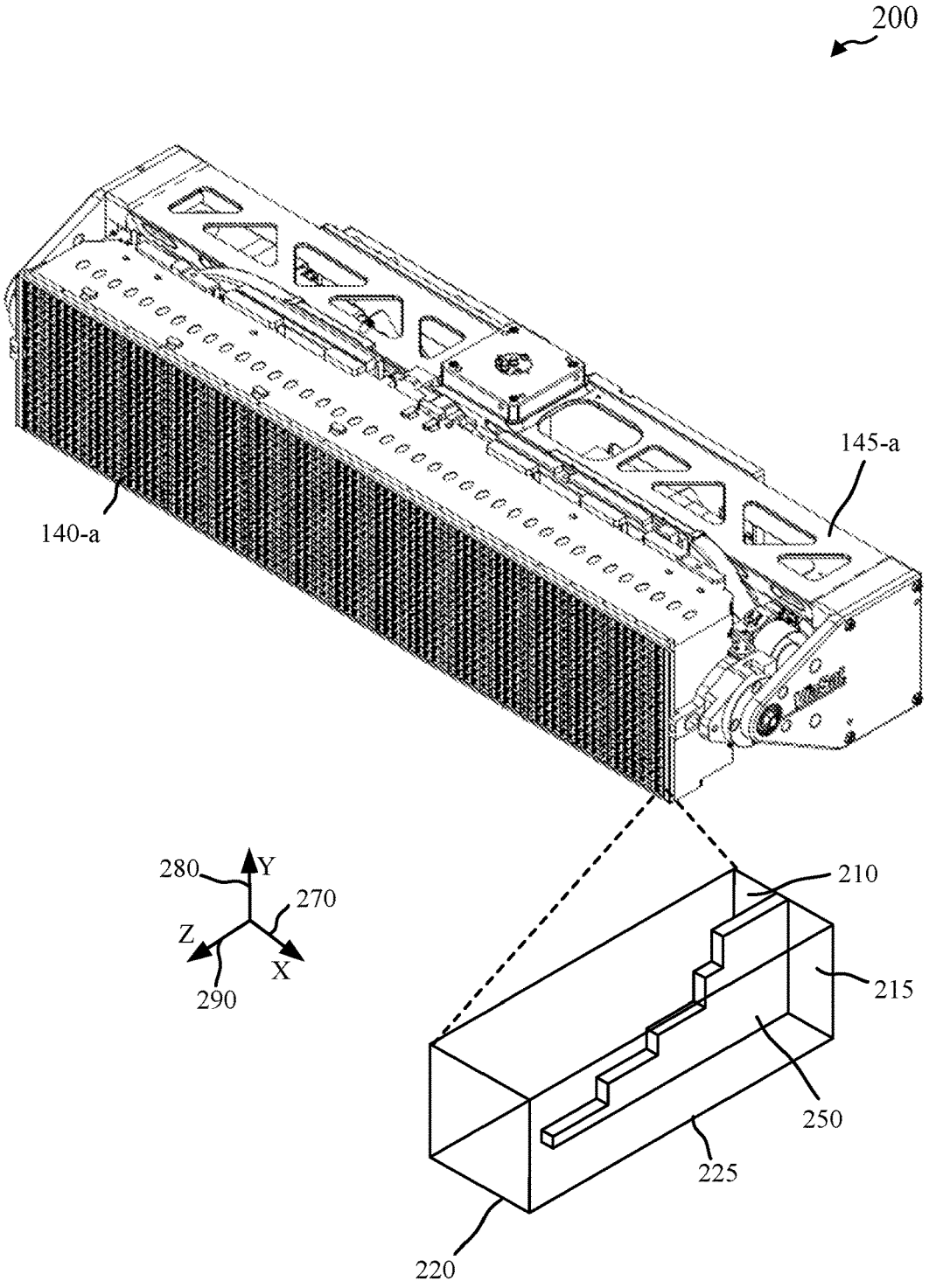
FIG. 2 shows a view of an antenna assembly in accordance with aspects of the present disclosure.

FIG. 2 shows a view of an antenna assembly 200 in accordance with aspects of the present disclosure. As shown in FIG. 2, antenna assembly 200 includes dual-polarized antenna 140-*a* and positioner 145-*a*, which may be, for example, the antenna 140 and positioner 145 illustrated in FIG. 1. Dual-polarized antenna 140-*a* includes multiple antenna elements 225, which may be arranged (e.g., in an array, etc.) to provide an antenna beam with desired characteristics. One antenna element 225 is shown in greater detail with reference to an X-axis 270, Y-axis 280, and Z-axis 290.

Each antenna element 225 may include an individual waveguide 220 for emitting and receiving waves and a polarizer. The polarizer can convert a signal between dual polarization states in the individual waveguide 220 and two signal components in respective divided waveguides 210 and 215 that correspond to orthogonal basis polarizations. This facilitates simultaneous dual-polarized operation. For example, from a receive perspective, the polarizer can be thought of as receiving a signal in the individual waveguide 220, taking the energy corresponding to a first basis polarization of the signal and substantially transferring it into a first divided waveguide 210, and taking the energy corresponding to a second basis polarization of the signal and substantially transferring it into a second divided waveguide 215. From a transmit perspective, excitations of the first divided waveguide 210 results in energy of the first basis polarization being emitted from the individual waveguide 220 while the energy from excitations of the second divided waveguide 215 results in energy of the second basis polarization being emitted from the individual waveguide 220.

The polarizer may include an element that is asymmetric to one or more modes of signal propagation. For example, the polarizer may include a septum 250 configured to be symmetric to the $TE_{10}$ mode (e.g., component signals with their E-field along Y-axis 280 in individual waveguide 220) while being asymmetric to the $TE_{01}$ mode (e.g., component signals with their E-field along X-axis 270 in individual waveguide 220). The septum 250 may facilitate rotation of the $TE_{01}$ mode without changing signal amplitude, which may result in addition and cancellation of the $TE_{01}$ mode with the $TE_{10}$ mode on opposite sides of the septum 250. From the dividing perspective (e.g., a received signal propagating in the individual waveguide 220 in the negative Z-direction), the $TE_{01}$ mode may additively combine with the $TE_{10}$ mode for a signal having right hand circular polarization (RHCP) on the side of the septum 250 coupled with the first divided waveguide 210, while cancelling on the side of the septum 250 coupled with the second divided waveguide 215. Conversely, for a signal having left hand circular polarization (LHCP), the $TE_{01}$ mode and $TE_{10}$ mode may additively combine on the side of the septum 250 coupled with the second divided waveguide 215 and cancel each other on the side of the septum 250 coupled with the first divided waveguide 210. Thus, the first and second divided waveguides 210, 215 may be excited by orthogonal basis polarizations of polarized waves incident on the individual waveguide 220, and may be isolated from each other. In a transmission mode, excitations of the first and second divided waveguides 210, 215 (e.g., $TE_{10}$ mode signals) may result in corresponding RHCP and LHCP waves, respectively, emitted from the individual waveguide 220.

The polarizer may be used to transmit or receive waves having a combined polarization (e.g., linearly polarized signals having a desired polarization tilt angle) at the individual waveguide 220 by changing the relative phase of component signals transmitted or received via the first and second divided waveguides 210, 215. For example, two equal-amplitude components of a signal may be suitably phase shifted and sent separately to the first divided waveguide 210 and the second divided waveguide 215, where they are converted to an RHCP wave and an LHCP wave at the respective phases by the septum 250. When emitted from the individual waveguide 220, the LHCP and RHCP waves combine to produce a linearly polarized wave having an orientation at a tilt angle related to the phase shift introduced into the two components of the transmitted signal. The transmitted wave is therefore linearly polarized and can be aligned with a polarization axis of a communication system. Similarly, a wave having a combined polarization (e.g., linear polarization) incident on individual waveguide 220 may be split into component signals of the basis polarizations at the divided waveguides 210, 215 and recovered by suitable phase shifting of the component signals in a receiver. Although the polarizer is illustrated as a stepped septum polarizer, other types of polarizers may be used including sloped septum polarizers or other polarizers.

The antenna element 225 may operate over one or more frequency bands, and may operate in a uni-directional (transmit or receive) mode or in a bi-directional (transmit and receive) mode. For example, the antenna element may be used to transmit and/or receive a dual-band signal (e.g., using two signal carrier frequencies). In some instances, the antenna element 225 may operate in a transmission mode for a first polarization (e.g., LHCP, first linear polarization) while operating in a reception mode for a second, orthogonal polarization in the same or a different frequency band.

The multiple antenna elements 225 include waveguide networks (discussed in more detail below) that can provide for a small inter-element distance relative to the operating frequency range which can reduce or eliminate grating lobes. Further, the described waveguide networks improve efficiency by coupling common feed ports to the divided waveguides 210, 215 of multiple antenna elements 225 using continuous waveguide signal paths without changes in transmission medium. The described waveguide networks may include ridged waveguide components and/or non-ridged waveguide components. In addition, the described waveguide networks can maintain equal path lengths between waveguide networks feeding each divided waveguide 210, 215 for the antenna elements 225. According to aspects of the present disclosure, the waveguide feed networks include initial combiner/divider stages connected to the antenna elements 225 that route waveguide signal paths from divided waveguides 210 and 215 of a set of antenna elements 225 to a common port within a projection of a cross-sectional boundary of the set of antenna elements 225 while maintaining a desired (e.g., small) inter-element distance between antenna elements 225. These techniques provide a scalable architecture for connecting divided waveguides of multiple antenna elements using continuous waveguide signal paths. To manufacture increasingly large waveguide networks, a waveguide network may be split into one or more waveguide blocks instead of manufacturing using increasingly larger single-piece waveguide blocks. Techniques described herein may provide for a RF seal between such split waveguide blocks that may facilitate greater manufacturing tolerances while maintaining an effective RF seal at the junction of the split waveguide blocks.

The positioner 145-*a* may include an elevation motor and gearbox, an elevation alignment sensor, an azimuth motor and gearbox, and an azimuth alignment sensor. These components may be used to point the dual-polarized antenna 140-*a* at the satellite (e.g., satellite 105 in FIG. 1) during operation.

Figure 3A:
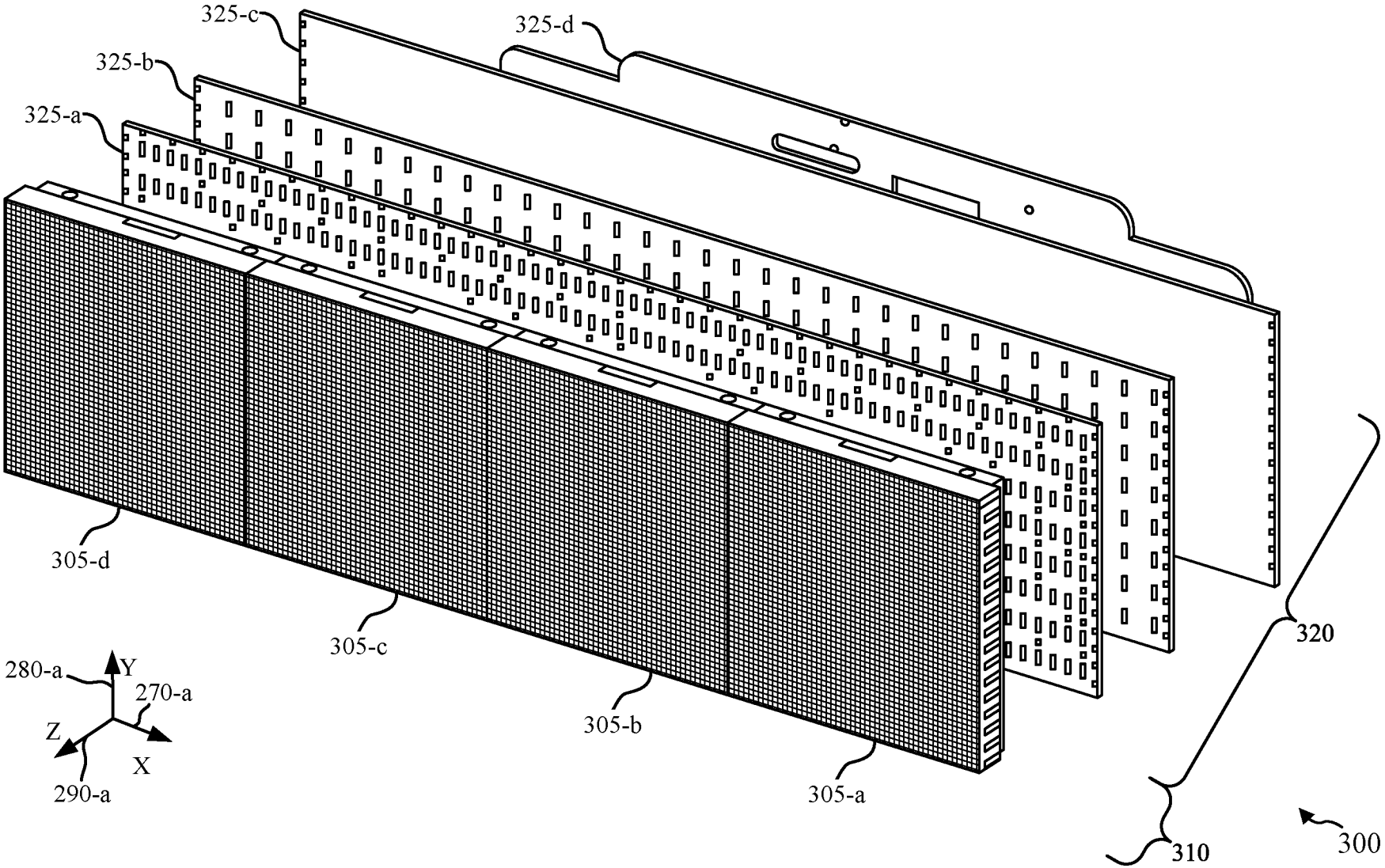
FIG. 3A shows an exploded perspective view of an antenna assembly in accordance with aspects of the present disclosure.

FIG. 3A shows an exploded perspective view of an antenna assembly 300 in accordance with aspects of the present disclosure. As shown in FIG. 3A, antenna assembly 300 includes an antenna aperture stage 310 and a feed network 320. Antenna assembly 300 is shown with reference to an X-axis 270-*a*, Y-axis 280-*a*, and Z-axis 290-*a*. The antenna assembly 300 may be an example of a component of the antennas 140 as described with reference to FIGS. 1 and 2, or may be used with other devices or systems.

The antenna aperture stage 310 may include multiple antenna elements (e.g., antenna elements 225) and one or more waveguide feed stages, each of which includes a first set of waveguide combiner/dividers associated with a first polarization and a second set of waveguide combiner/dividers associated with a second polarization.

Figure 3B:
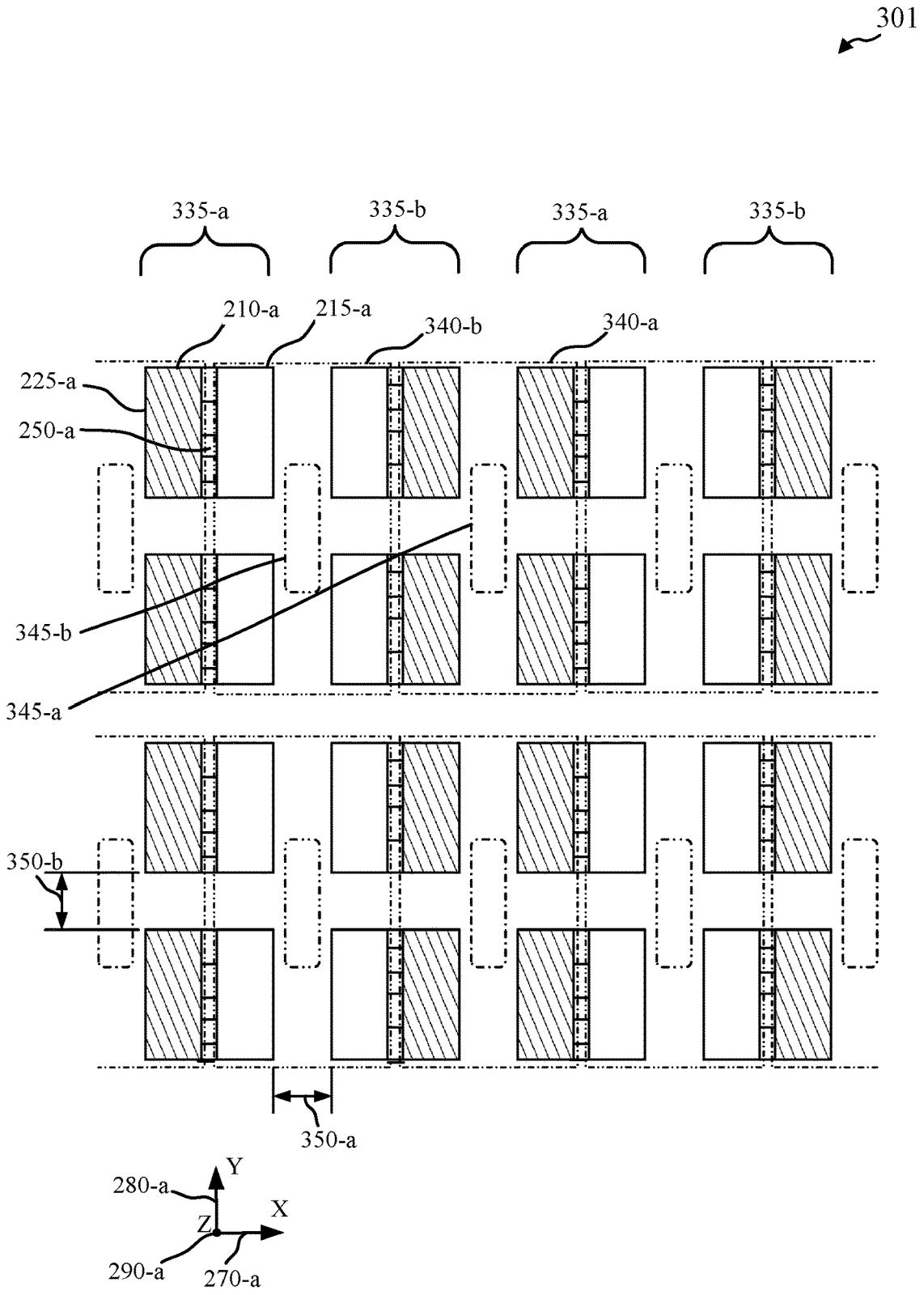
FIG. 3B shows a front view of a section of an antenna aperture stage in accordance with aspects of the present disclosure.

FIG. 3B shows a front view 301 of a section of antenna aperture stage 310 in accordance with aspects of the present disclosure. FIG. 3B illustrates antenna elements 225-*a* (only one of which is labeled, for clarity), where each antenna element 225-*a* includes a septum 250-*a* dividing the antenna element 225-*a* into a first divided waveguide 210-*a* and a second divided waveguide 215-*a*. It may be desirable to maintain short inter-element distances 350-*a* and 350-*b* to reduce grating lobes. For example, the inter-element distance 350-*a* in the X direction and the inter-element distance in the Y-direction may be less than one-half or less than one-quarter of a wavelength at an operational frequency of the antenna aperture stage 310. The antenna elements 225-*a* may be divided into two sets—a first set of antenna elements 335-*a* and a second set of antenna elements 335-*b*. The first set of antenna elements 335-*a* may have a first orientation in the antenna aperture stage 310 and the second set of antenna elements 335-*b* may have a second orientation in the antenna aperture stage 310. The second orientation may be opposite, or inverted, from the first orientation. The second orientation may be, for example, rotated by 180 degrees about the Z-axis 290-*a* from the first orientation. The first and second sets of antenna elements may be arranged into separate and alternating columns of the antenna aperture stage 310, where FIG. 3B illustrates four columns of the antenna aperture stage 310. As illustrated in FIG. 3B, interleaving the sets of antenna elements 335-*a* and 335-*b* results in divided waveguide ports 210 and 215 corresponding to the same polarization being adjacent to one another.

The view 301 illustrates four columns of antenna elements 225, which may correspond to columns of antenna elements in FIGS. 2 and 3A. The columns may include alternating antenna elements (alternating septum polarizers) as discussed above. Four adjacent divided waveguides 215-*a* may be grouped together into a 2×2 divided waveguide group 340-*a*. That is, the divided waveguide group 340-*a* includes a group of four adjacent divided waveguides 210-*a* associated with a first polarization. Each divided waveguide group 340-*a* may illustrate the waveguide coupling between a first common port 345-*a* of a first combiner/divider and the divided waveguides 210-*a*.

Likewise, four adjacent divided waveguides 215-*a* may be grouped together into a 2×2 divided waveguide group 340-*b*. That is, the divided waveguide group 340-*a* includes second groups of four adjacent divided waveguides 215-*a*. Each divided waveguide group 340-*b* may illustrate the waveguide coupling between a second common port 345-*b* of a second combiner/divider and the divided waveguides 215-*a*.

The view 301 includes two complete and four incomplete divided waveguide groups 340-*a* associated with the first polarization and four complete divided waveguide groups 340-*b* associated with the second polarization. It should be understood that additional rows may be included above and below view 301, and additional columns of antenna elements 225-*a* may be included to the sides of view 301 in the antenna aperture stage 310.

In other words, the antenna aperture stage 310 may include a first stage of a feed network that combines the divided waveguide ports 210, 215 associated with the same polarization by groups of 2×2. Grouping the divided waveguides 210 and 215 by polarization type in this way allows for the combiner/dividers in the antenna aperture stage 310 to be coincident with each other along the Z axis 290-*a*.

The combiner/dividers for the divided waveguide groups 340-*a* and 340-*b* may be implemented in a variety of ways. For example, a 4-to-1 combiner/divider may be implemented by a succession of H-plane (e.g., in the magnetic field direction) and E-plane (e.g., in the electric field direction) combiner/dividers, for instance, or the same in the reverse order. They may also be implemented by a cavity-based structure with one port at the bottom and four ports at the top. Although the structure of the combiner/dividers used to combine/divide divided waveguide groups 340-*a* and 340-*b* are not shown in view 301, it can be understood that waveguides will extend in the X-Y plane from the common ports to the divided waveguides in both the X and Y directions (e.g., first in the X direction along the Z-axis, then in the Y direction, or vice versa, or in both directions at the same position along the Z-axis.).

Returning to FIG. 3A, the feed network 320 may be a layered assembly including multiple layers 325 (e.g., layers 325-*a*, 325-*b*, 325-*c*, and 325-*d*). In the example shown in FIG. 3A, the layers 325 are oriented in the Y-Z plan (e.g., parallel to the transverse plane of the antenna elements 225 of the dual-polarized antenna). Each layer 325 may include holes and/or recesses in one or more surfaces that define portions of waveguide networks such as elevation power combiner/divider networks and azimuth combiner/dividers. The antenna aperture stage may have ports for interfacing with the feed network 320. For example, the antenna aperture stage may have two ports (e.g., one for each of two polarizations) for each of four antenna elements 225. Each of the ports on the antenna aperture stage 310 may interface with the feed network 320 via, for example, a quarter-wavelength choke (not shown). The quarter-wavelength chokes may be on feed network 320 or the blocks 305 of the antenna aperture stage 310.

In some examples, the layers 325 are manufactured using a first type of manufacturing process and the antenna aperture stage may be manufactured using a second, different type of manufacturing process. Thus, the overall antenna assembly 300 may be manufactured via a combination of different materials and different manufacturing techniques. Different properties of materials and manufacturing techniques can be used to obtain overall design characteristics. In some cases, different portions of the antenna assembly 300 may be made of rigid or stronger materials (e.g., machined aluminum) for purposes of structural integrity, whereas other portions can be manufactured via less structurally rigid materials such as polymers used in 3D printing. In one example, the layers 325 are machined aluminum waveguide sub-assemblies. The machined waveguide sub-assemblies 325 may be vacuum brazed together to form the feed network 320.

To provide efficient operation across the operational frequency range, it may be desirable to feed a large number of antenna elements using continuous waveguide combiner/divider networks (e.g., with no changes in propagation medium). To continue to increase an amount of divided waveguides and corresponding antenna elements in the described scalable architecture using a continuous waveguide signal paths, a density of the divided waveguides within one waveguide block may be increased and/or an overall size of the overall waveguide block may be increased. Some techniques of manufacture, however, may encounter difficulties when manufacturing such antenna arrays with a large overall size and densely packed waveguides. Because of the complexity and large size, it may be uneconomical and/or difficult to manufacture the entire antenna aperture stage 310 as one contiguous block. Some techniques of manufacture may not be capable of producing a single-piece waveguide block beyond a certain size. For example, a desired size of a large single-piece waveguide block may exceed the size and/or capabilities of a 3D printer used to manufacture the waveguide block. However, as can be seen in FIG. 3B, any sectioning of the antenna aperture stage 310 in the Y-Z plane will intersect with a waveguide of either the antenna elements 225-*a*, or the waveguides in the combiner/dividers of waveguide groups 340-*a* or 340-*b*.

According to one technique, the overall antenna aperture stage 310 may be manufactured as two or more waveguide blocks 305, where the waveguide blocks 305—when joined—form a continuous waveguide signal path from an antenna element to an intermediate waveguide or waveguide port between the antenna aperture stage 310 and the feed network 320. That is, the interface between waveguide blocks 305 may intersect one or more waveguides that would have otherwise been connected in a single-piece waveguide device. After coupling a first waveguide block 305 (e.g., waveguide block 305-*a*) to a second waveguide block 305 (e.g., waveguide block 305-*b*), a first section of a waveguide of waveguide block 305-*a* may form a substantially continuous path with a second section of the waveguide of the waveguide block 305-*b*. Similar interface techniques may be used between waveguide block 305-*b* and waveguide block 305-*c*, and between waveguide block 305-*c* and waveguide block 305-*d*. In some cases, the first waveguide block and/or the second waveguide block 305 may include one or more antenna elements or polarizers, where each of the one or more polarizers may include an individual waveguide and first and second divided waveguides associated with respective first and second polarizations. It should be understood that the example of FIGS. 3A and 3B is just one example of a waveguide device in which multi-block manufacturing of a waveguide device may be beneficial.

Some techniques for such multi-block manufacturing may require precise manufacturing of the waveguides to avoid potential loss in the electric current flows on the inside surface of the waveguides, or reflection in the connection of a waveguides from one waveguide block 305 to another. More precise manufacturing standards, however, may increase the manufacturing costs of the waveguide feed networks. Further, even despite higher manufacturing standards, imperfections may still occur in manufacturing the waveguide blocks 305. For example, there may be imperfections in the contact faces of two abutting waveguide blocks 305, for example, in the interface of waveguide block 305-*a* with waveguide block 305-*b*. This may cause partial or full dielectric gaps (e.g., air gaps) to form between in the interface of waveguide block 305-*a* with waveguide block 305-*b*. Such discontinuities and imperfections in the interface may adversely affect RF performance of the waveguide. For example, potential leaks and/or reflection may occur across in the interface, particularly at relatively higher frequencies, such as microwave frequencies.

One technique for mitigating such potential leaks and/or reflections in the interface of two waveguide blocks 305 may include using additional fasteners to more firmly hold together the respective waveguide blocks 305. Additionally or alternatively, another technique may include bonding together the waveguide blocks 305 with an electrically conductive adhesive, or RF-sealing the gaps with electrically conductive gaskets. However, in some cases, a solution using a contactless interface may provide benefits over these techniques, which may or may not be possible in certain situations. For example, the aforementioned techniques for sealing the gap may not work with some manufacturing techniques (e.g., 3D printing), or may provide inferior performance to that of a contactless technique. Accordingly, the techniques described herein may provide for RF sealing between waveguide blocks 305 that may facilitate greater manufacturing tolerances while maintaining an effective RF seal at the junction of the waveguide blocks 305.

In the case of 3D printing, the waveguide blocks 305 may be printed using any suitable material, such as metal, plastic, or ceramics. In cases in which a waveguide block 305, or a portion thereof, is not made from metal, the waveguide block, or portion thereof, may be metal plated. In some cases, metal plating after 3D printing may be a reasonable and cost-effective possibility for generating a complex waveguide device such as antenna aperture stage 310 according to the techniques described herein. In some cases, various waveguide feed networks may be formed as machined sub-assembly layers in lieu of, or in addition to, 3D printing.

Figure 4A:
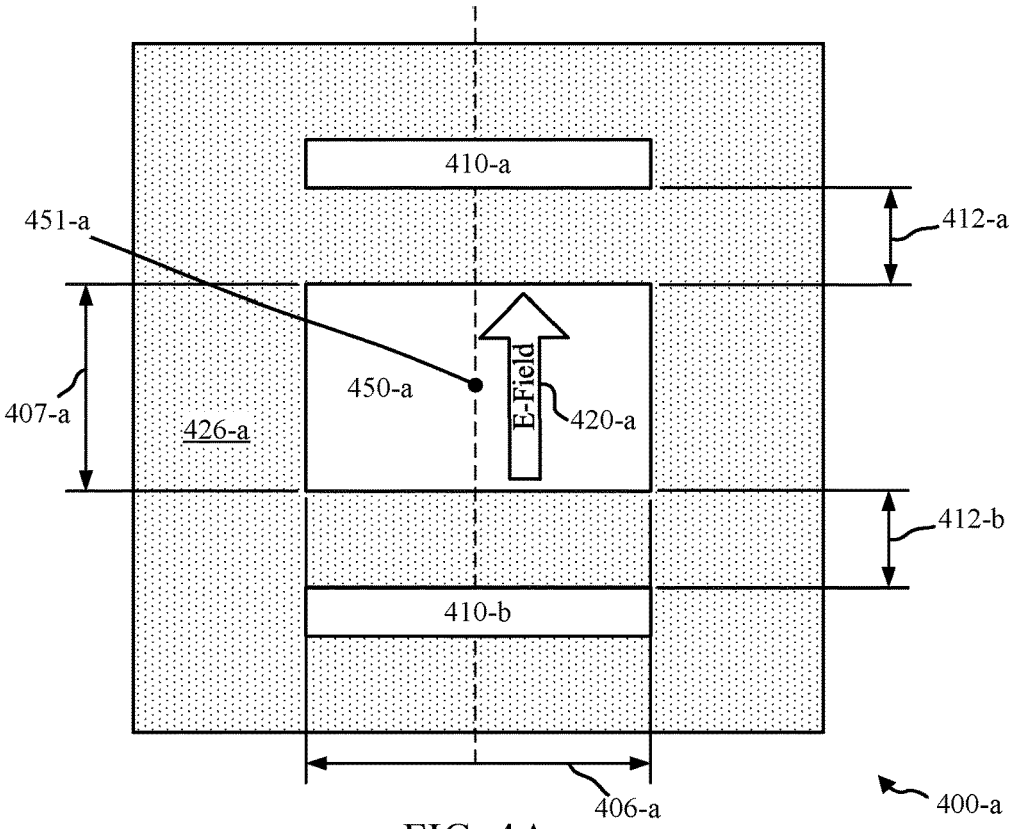
FIGS. 4A-4B show diagrams of a radio-frequency (RF) seal for a waveguide block interface in accordance with aspects of the present disclosure.
Figure 4B:
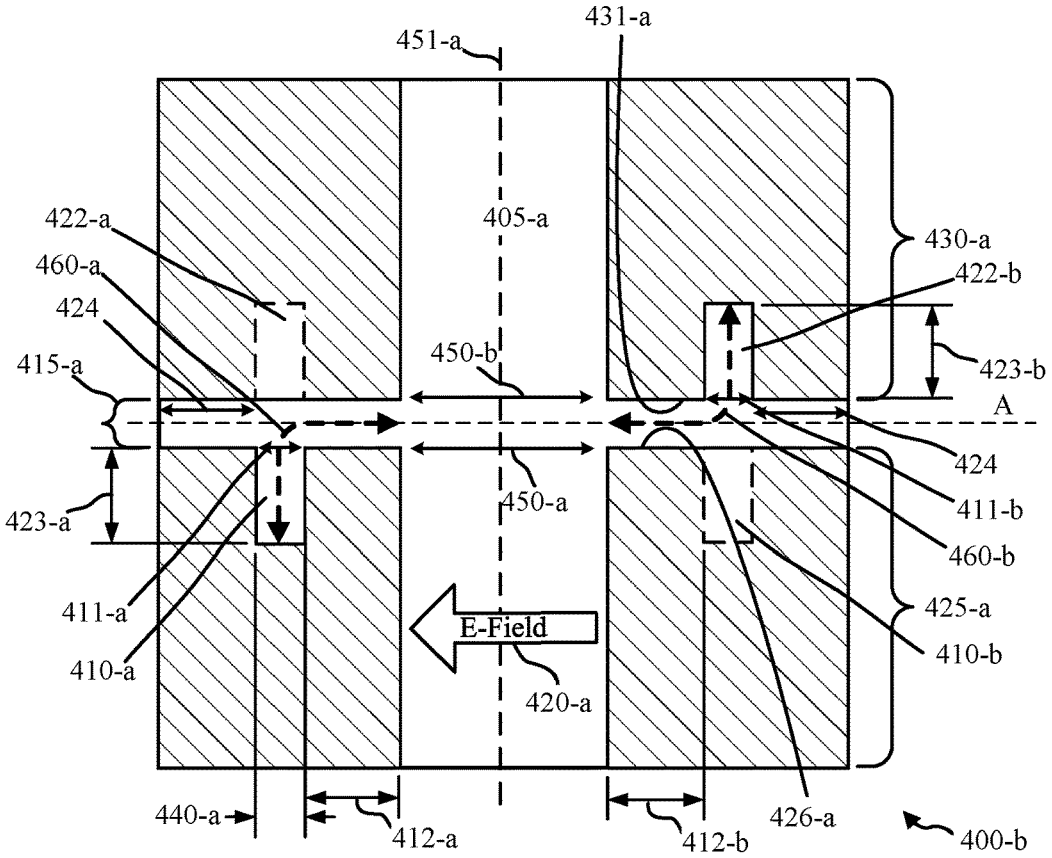

FIGS. 4A-4B show diagrams 400 of an RF seal for a waveguide block interface in accordance with aspects of the present disclosure. FIGS. 4A-4B may illustrate examples of a partial RF choke. The waveguide block interface may be an example of an interface between the waveguide blocks as described with reference to FIG. 3A.

FIG. 4A shows a diagram 400-*a* of a front view of the RF seal for the waveguide block interface. FIG. 4A may illustrate, for example, a view taken along section plane A of FIG. 4B. Thus, diagram 400-*a* may illustrate the face of a first waveguide block 425-*a* including an opening 450-*a* for a first portion of a waveguide 405-*a*. The E-field 420-*a* may show an E-plane reference plane for the waveguide 405-*a*. The E-plane corresponds to the direction of polarization of the waveguide 405-*a*. FIG. 4A shows center axis 451-*a* of the waveguide 405-*a*, which may be understood as an axis in the center of the waveguide that is perpendicular to a transverse plane of the waveguide at the opening 450-*a*.

As shown in FIG. 4B, the plane of the diagram 400-*a* is parallel (or substantially parallel) to a dielectric gap 415-*a* that is formed at the interface the face 426-*a* of the first waveguide block 425-*a* and the face 431-*a* of the second waveguide block 430-*a*. The dielectric gap 415-*a* may be the dielectric gap (e.g., an air gap) as described with reference to FIG. 3A. In some cases, the dielectric gap 415-*a* may be formed to accommodate imperfections from a particular manufacturing process (e.g., 3D printing). For example, the width of the dielectric gap 415-*a* may vary within a manufacturing tolerance at different points. Although FIGS. 4A and 4B show one waveguide 405-*a* in the first and second waveguide blocks 425-*a* and 430-*a*, respectively, it should be understood that each of the first and second waveguide blocks 425-*a* and 430-*a* may include many waveguides 405, such that sections of many waveguides are coupled with each other by mating the first and second waveguide blocks 425-*a* and 430-*a* together at the illustrated faces.

The channels 410-*a* and 410-*b* shown in FIGS. 4A and 4B may each extend into the face of the first waveguide block 425-*a*. In some cases, channels 410-*a* and 410-*b* may be formed with one or more sets of parallel walls (e.g., being of a parallelohedron shape). In some cases, a length of a first dimension of a cross section in a transverse plane of one or more of the channels 410 corresponds to a first dimension of the opening 450-*a*. For example, the H-plane dimension of the channels 410 may correspond to the H-plane dimension 406-*a* of the opening 450-*a*. In some examples, a length of a second dimension of the cross section of the channels 410 is less than a second dimension of the opening 450-*a*. For example, the E-plane dimension of the channels 410 may be less than the E-plane dimension 407-*a* of the opening 450-*a*. The channels 410-*a* and 410-*b* are shown to each be located at a length 412-*a* along the face 426-*a* of the first waveguide block 425-*a* in the E-plane dimension from a wall of the opening 450-*a*.

FIG. 4B shows a diagram 400-*b* of a side view of the RF seal for the waveguide block interface. The side view shown in diagram 400-*b* may, for example, illustrate a section plane B of diagram 400-*a* (rotated in the page by 90 degrees). Diagram 400-*b* illustrates a side view of first waveguide block 425-*a* having an opening 450-*a* for a first portion of a waveguide 405-*a* and second waveguide block 430-*a*, the face 431-*a* of the second waveguide block 430-*a* having an opening 450-*b* for a second portion of the waveguide 405-*a*.

FIG. 4B illustrates a side view of the dielectric gap 415-*a* that is formed at the interface between the face 426-*a* of the first waveguide block 425-*a* and the face 431-*a* of the second waveguide block 430-*a*. The dielectric gap 415-*a* may be the dielectric gap (e.g., an air gap) as described with reference to FIG. 3A. Channels 410-*a* and 410-*b* are also shown. The channels 410-*a* and 410-*b* may extend into the face of the first waveguide block 425-*a*. Alternatively, channel 410-*b* may extend into the face of the first waveguide block 425-*a* while a second channel 422-*a* extends into the second waveguide block 430-*a* (channel 410-*a* being absent). According to this design, channels 410-*b* and 422-*a* are on opposite sides of the dielectric gap 415-*a*. Yet alternatively, channel 410-*a* may extend into the first waveguide block while a second channel 422-*b* extends into the second waveguide block 430-*a* (channel 410-*b* being absent). Possible positions for alternative channels 422 are also shown at points at lengths 412-*a* or 412-*b* from the opening 450-*b* on the face of the second waveguide block 430-*a*. Accordingly, operable designs are contemplated in which the channels are located on the same face or on opposite faces. Channels 410-*a* and 410-*b* are shown to be perpendicular to the dielectric gap 415-*a*. In some cases, however, the channels 410-*a* and 410-*b* may be formed at any other angle within the waveguide blacks, for example, to facilitate the design of the waveguide combiner/dividers.

As is also shown in FIG. 4B, the channels 410, 422 (if present) are a length 412-*b* along the face of the first waveguide block 425-*a* from the opening 450-*a*. In some cases, the channels 410 or 422 may be blind waveguide stubs (e.g., having only one free or open end 411, with the other end blind or short circuited). In aspects, the sum of length 412-*a* and length 423-*a* may be one-half wavelength or a multiple of one-half wavelength with reference to an operational frequency of the waveguide 405-*a* (e.g., a carrier frequency or center frequency of an operational frequency range of the waveguide 405-*a*). For example, length 412-*a* may be one-quarter wavelength (or any integer multiple of one-quarter wavelength having an odd numerator such as three-quarters of the wavelength) and length 423-*a* may be one quarter wavelength (or any multiple of one-quarter wavelength having an odd numerator such as three-quarters of the wavelength). Similarly, the sum of length 412-*b* and length 423-*b* may be one-half wavelength or a multiple of one-half wavelength (e.g., each of length 412-*b* and length 423-*b* may be one-quarter wavelength or any integer multiple of one-quarter wavelength having an odd numerator such as three-quarters of the wavelength). In some cases, the channels 410 or 422 may be open waveguide stubs (e.g., having both ends open). Thus, the sum of length 412-*a* and length 423-*a* may be three-quarters of the wavelength, in some examples where channels 410 or 422 are open waveguide stubs. In some examples, the length 412-*a* and the length 412-*b* may be the same. However, in some examples they may be different, with corresponding differences in lengths 423-*a* and 423-*b*.

Accordingly, after mating the face 426-*a* of the first waveguide block 425-*a* to the face 431-*a* of the second waveguide block 430-*a*, a half-wavelength stub 460 may be formed on each side of the waveguide 405-*a* in the E-plane dimension ending at the end of each of the channels 410 or 422. For example, a half-wavelength E-plane stub 460-*a* may be formed by a portion of the dielectric gap 415-*a* between the waveguide 405-*a* and the channel 410-*a* in combination with the channel 410-*a* itself. Similarly, a half-wavelength E-plane stub 460-*b* may be formed by the dielectric gap 415-*a* between the waveguide 405-*a* and the quarter-wavelength channel 422-*b* in combination with the channel 422-*b* itself.

According to various aspects, waveguide stubs 460 present a low-impedance across dielectric gap 415-*a* in series with the waveguide 405-*a* at the edges of the openings 450. In particular, a high impedance (e.g., approaching infinite) impedance is created at the opening 411-*a* of channel 410 or the opening 411-*b* of channel 422. For example, where the ends of channels 410 or 422 are electrically shorted (e.g., a zero impedance), a high (e.g., approaching infinite) impedance is created at a distance of one-quarter wavelength (or at additional one-half wavelength distances) away from the electrically shorted end. The high impedance may also be created at the opening 411-*a* of channel 410 or the opening 411-*b* of channel 422 using open channels 410 or 422 having a depth as shown by lengths 423 of one-half wavelength (or any integer multiple of one-half wavelength). The high impedance is in series with the portions 424 of the dielectric gap 415-*a* that are opposite of the channels 410 or 422 from the openings 450. Because the portions 424 of the dielectric gap 415-*a* that are opposite of the channels 410 or 422 from the waveguide opening 405-*a* are in series with the infinite or near-infinite impedance at the intersection of the openings 411 of channels 410 or 422 and the dielectric gap 415-*a*, any impedance due to portions 424 of the dielectric gap (which may be variable depending on the thickness and effective length of the dielectric gap 415-*a*) does not significantly affect the impedance at the edges of the openings 450. Thus, the impedance across dielectric gap 415-*a* in series with the waveguide 405-*a* at the edges of the openings 450 appears as an electrical short because it is a quarter-wavelength from a high (e.g., approaching infinite) impedance. Thus, electric current on the inside surface of the waveguide sees a short circuit across the dielectric gap 415-*a* at the opening 450-*a*, which electrically removes the dielectric gap 415-*a* (electrically makes it appear as a continuous waveguide wall). Consequently, the electromagnetic wave inside the waveguide, induced by the electric current on the waveguide surfaces, passes between the waveguide blocks substantially unaffected by the dielectric gap 415-*a*. The low impedance seen by the electric current on the waveguide walls at the openings 450 due to the waveguide stubs 460 may be, for example, substantially lower than the wave impedance of the waveguide, and thus, when compared with the wave impedance, effectively a zero impedance. For example, wave impedance of a waveguide may be approximately 500 Ohms, and the impedance at the openings 450 due to the waveguide stubs 460 may be less than 50 Ohms, less than 25 Ohms, or less than 5 Ohms. This may accordingly provide continuity in the flow of electric current on the inside surface of the waveguide 405-*a*. Thus, the dielectric gap 415-*a* may be rendered essentially negligible, and the interface of the first wave waveguide block 425-*a* and the second waveguide block 430-*a* may provide what is effectively a continuous waveguide 405-*a*.

According to various aspects, many waveguide blocks may be appended to each other to form a large array of many waveguide blocks 425 and 430. As some methods of manufacturing (e.g., 3D printing, as described with respect to FIG. 3) may not be able to manufacture an array housing each element of a waveguide device, the described techniques accordingly provide a method for manufacturing a large waveguide device without needing to manufacture the individual waveguide blocks to a higher tolerance level. Further, the described waveguide blocks may be able to RF-seal relatively wider dielectric gaps 415-*a* than may be possible according to other techniques. For example, for an antenna operating in the ITU Ka-band, the described waveguide blocks may be able to RF-seal a dielectric gap 415-*a* of up to several millimeters. Moreover, the described RF seal may be insensitive to deviations within the sealable width. For example, manufacturing defects or irregularities of multiple millimeters of the width of the dielectric gap 415-*a* at different points may not degrade the RF-sealing properties at the interface of the waveguide blocks. This tolerance of deviations in the width may allow a manufacturing design to include an air gap at the interface to facilitate multiple abutting waveguide blocks, and generate cost and resource savings (i.e., lowering production costs) in the manufacture of the waveguide blocks by allowing the waveguide blocks to be manufactured to less exacting tolerances.

Figure 5A:
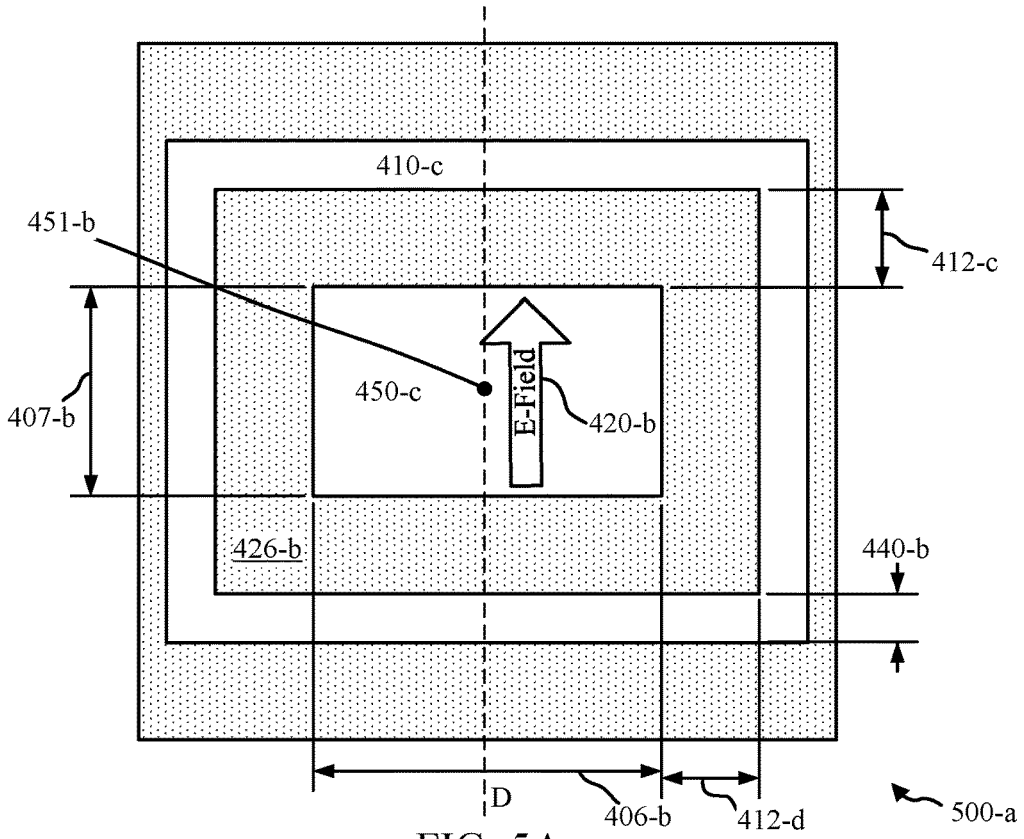
FIGS. 5A-5B show diagrams of a RF seal for a waveguide block interface in accordance with aspects of the present disclosure.
Figure 5B:
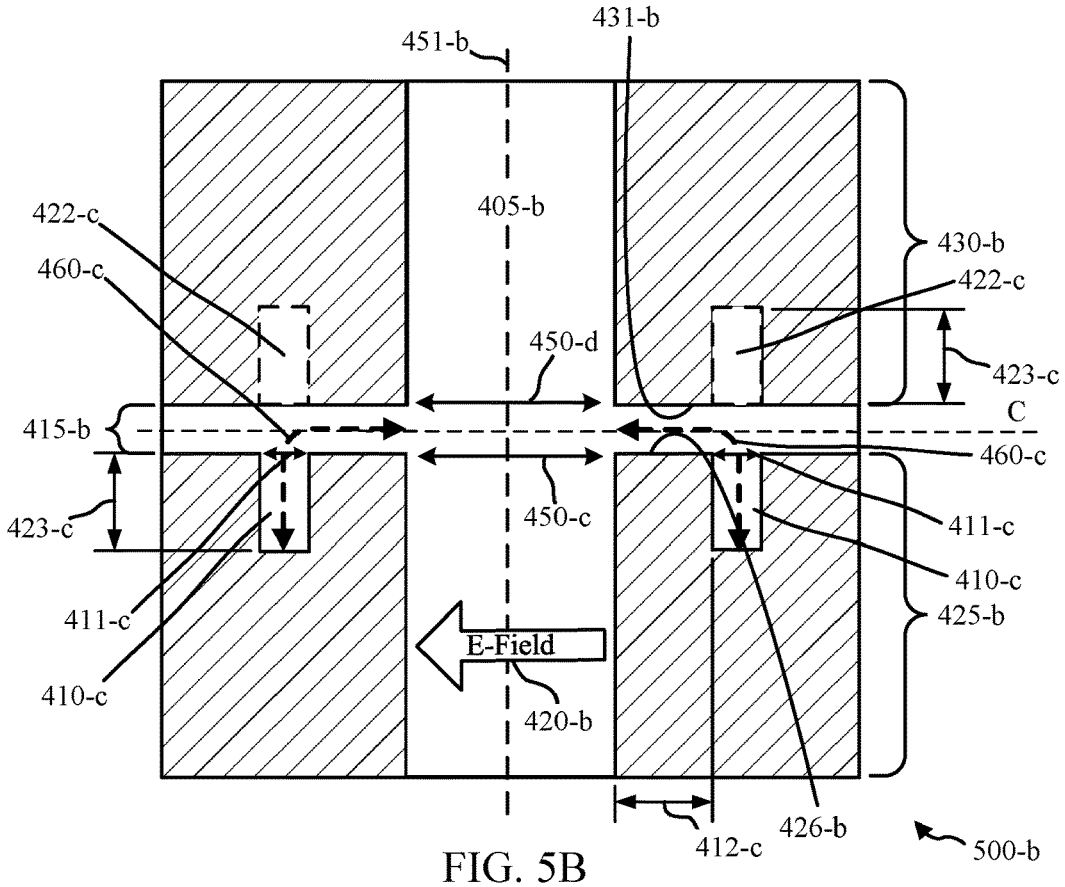

FIGS. 5A-5B show diagrams 500 of an RF seal for a waveguide block interface in accordance with aspects of the present disclosure. FIGS. 5A-5B may illustrate an example of a full RF choke at a waveguide block interface. The waveguide block interface may be an example of an interface between the waveguide blocks as described with reference to FIGS. 3A-3B and 4A-4B. FIG. 5A shows center axis 451-*b* of the waveguide 405-*b*, which may be understood as an axis in the center of the waveguide that is perpendicular to a transverse plane of the waveguide at the opening 450-*c*.

FIG. 5A shows a diagram 500-*a* of a front view of the RF seal for the waveguide block interface. The diagram 500-*a* illustrates a face 426-*b* of a first waveguide block 425-*b*, the face 426-*b* of the first waveguide block 425-*b* having an opening 450-*c* for a first portion of a waveguide 405-*b*. The opening 450-*c* may have an H-plane dimension 406-*b* and an E-plane dimension 407-*b*. The diagram 500-*a* may illustrate the view of the face of the first waveguide block 425-*b* at section plane C in FIG. 5B. FIG. 5A illustrates E-field direction 420-*b* of the waveguide 405-*b*. FIG. 5B may illustrate the interface between the first waveguide block 425-*b* and a second waveguide block 430-*b*. The side view of diagram 500-*b* shown in FIG. 5B may illustrate, for example, the section plane D in FIG. 5A (rotated by 90 degrees on the page). As shown in FIG. 5B, the face 431-*b* of the second waveguide block 430-*b* may have an opening 450-*d* for a second portion of the waveguide 405-*b*.

As shown in FIG. 5B, a dielectric gap 415-*b* is formed at the interface between the face 426-*b* of the first waveguide block 425-*b* and the face 431-*b* of the second waveguide block 430-*b*. The dielectric gap 415-*b* may be the dielectric gap (e.g., an air gap) as described with reference to FIGS. 3A-3B and 4A-4B. The dielectric gap 415-*b* may be less than that of an E-plane dimension of the waveguide 405-*b*. A channel 410-*c* in the first waveguide block 425-*b* is shown in FIGS. 5A and 5B. The channel 410-*c* may extend into the face of the first waveguide block 425-*b*. In some cases, the channel 410-*c* may be formed with a set of parallel walls and may encircle the opening in the first waveguide block 425-*b* for the waveguide 405-*b* as shown in FIG. 5A. The channel 410-*c* is shown to be a length 412-*c* in the E-plane direction and a length 412-*d* in the H-plane direction from the waveguide 405-*b* along the face of the first waveguide block 425-*b*. The lengths 412-*c* and 412-*d* may be a quarter-wavelength (or any multiple of one-quarter wavelength having an odd numerator such as three-quarters of the wavelength). The opening 411-*c* of the channel 410-*c* may have a dimension that is less than the E-plane dimension 407-*b* of the openings 450-*c* and 450-*d*. Whereas the channels 410 or 422 as described with reference to FIGS. 4A-4B do not encircle the openings 450, the channel 410-*c* may fully encircle the opening 450-*c*. In another implementation, the channel 410-*c* may include a turn extending the channel along more than one dimension of the opening 450-*c* (e.g., at least one H-plane dimension and one E-plane dimension), but, for example, may not completely encircle the opening 450-*c*. In some cases, the width 440-*b* of the channel 410-*c* may be less than that of an E-plane dimension 407-*b* of the waveguide 405-*b*. Although shown with square corners, the corners of channel 410-*c* may be rounded, in some cases.

FIG. 5B also illustrates an alternative channel 422-*c* in the second waveguide block 430-*b*. Alternative channel 422-*c* may also be located at a length 412-*b* in the E-plane direction and a length 412-*d* in the H-plane direction from the opening 450-*d*. Accordingly, operable designs are contemplated in which a channel forming a full choke (e.g., encircling waveguide 405-*b*) is located on either the face 426-*b* of the first waveguide block 425-*b* or the face 431-*b* of the second waveguide block 430-*b*. According to various aspects, channel 410-*c* in the first waveguide block 425-*b* may partially encircle (e.g., extending at least partially along one H-plane dimension and at least partially along one E-plane dimension) the opening 450-*c*, while channel 422-*c* in the second waveguide block 430-*b* also at least partially encircles the opening 450-*d*. For example, the combined channel including both the channel 410-*c* and the channel 422-*c* may fully or almost fully encircle the waveguide 405-*b*. Thus, channels 410-*c* and 422-*c* may be formed in both the first and second waveguide blocks, respectively, and the combined channel may form a full choke. Channels 410-*c* and 422-*c* are shown to be perpendicular to the dielectric gap 415-*b*. In some cases, however, the channels 410-*c* and/or 422-*c* may be formed at any other angle within the waveguide blocks, for example, to facilitate the design of the waveguide combiner/dividers.

As can be seen in FIG. 5B, after mating the face 426-*b* of the first waveguide block 425-*b* to the face 431-*b* of the second waveguide block 430-*b*, a waveguide stub 460-*c* may be formed on multiple sides of the waveguide 405-*b* (e.g., up to and including encircling the waveguide 405-*b*) ending at the end of each of the portions of the channel 410-*c*. In some cases, the channels 410-*c* or 422-*c* may be blind waveguide stubs. The sum of length 412-*c* and length 423-*c* may be one-half wavelength at an operating frequency of the waveguide device. For example, the length 412-*c* may be one-quarter wavelength (or any integer multiple of one-quarter wavelength having an odd numerator such as three-quarters of the wavelength) at an operating frequency of the waveguide device. The channels 410-*c* or 422-*c* may also have a depth given by length 423-*c* of one-quarter wavelength (or any integer multiple of one-quarter wavelength having an odd numerator such as three-quarters of the wavelength). Alternatively, the length 412-*c* may be longer or shorter than the length 423-*c*. Thus, a half-wavelength stub may be formed with each of the portions of the dielectric gap 415-*b* of length 412-*c* between the opening 450-*d* and the channel 410-*c* or 422-*c* on the face of the waveguide block 425-*b* or 430-*b* in combination with the length 423-*c* of channel 410-*c* or 422-*c* itself. In some cases, the channels 410-*c* or 422-*c* may be open waveguide stubs. In these cases, channels 410-*c* or 422-*c* may have a depth given by length 423-*c* of one-half wavelength (or any integer multiple of one-half wavelength).

Figure 6A:
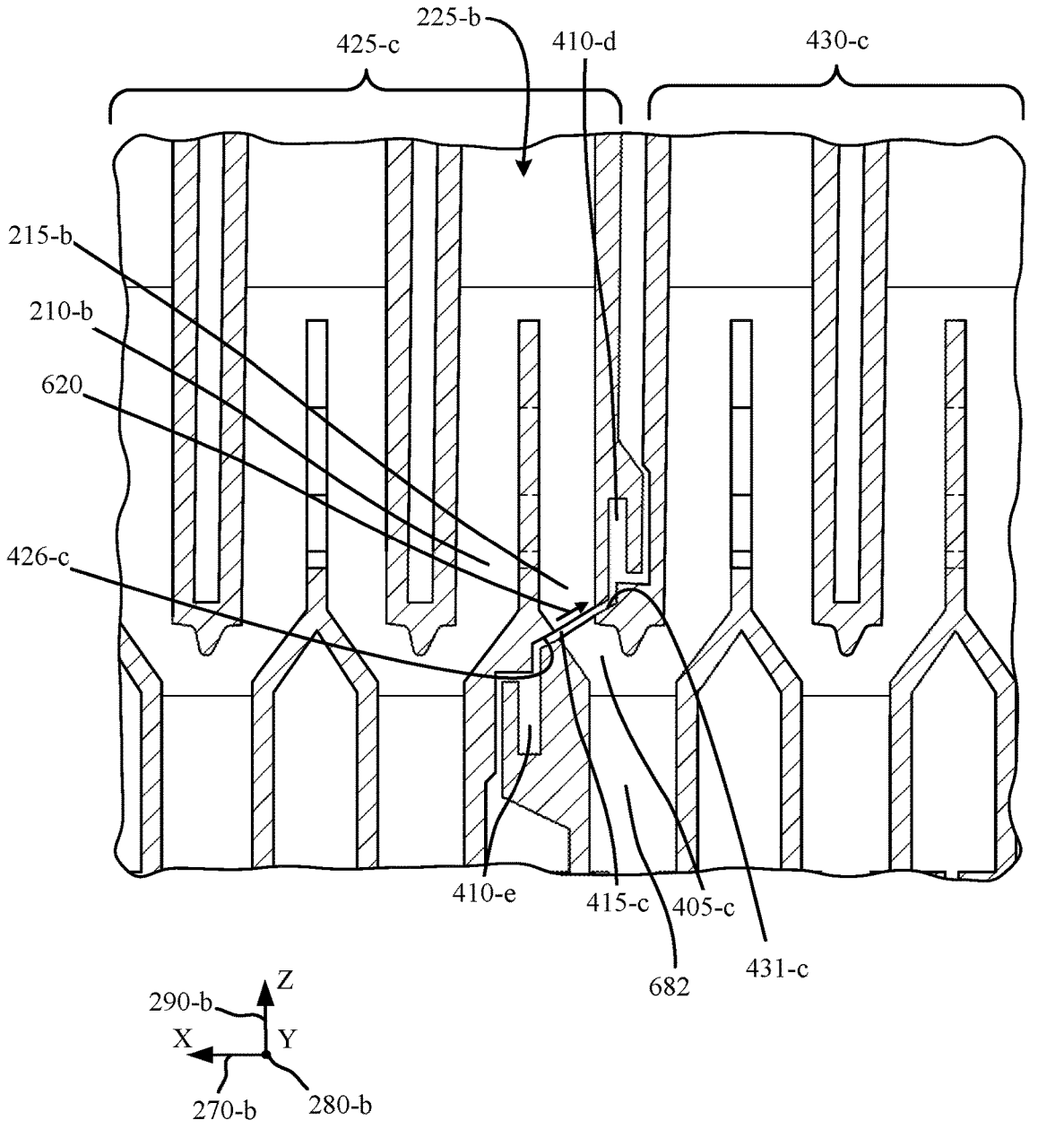
FIGS. 6A-6C show views of an RF seal for a waveguide block interface in accordance with aspects of the present disclosure.
Figure 6B:
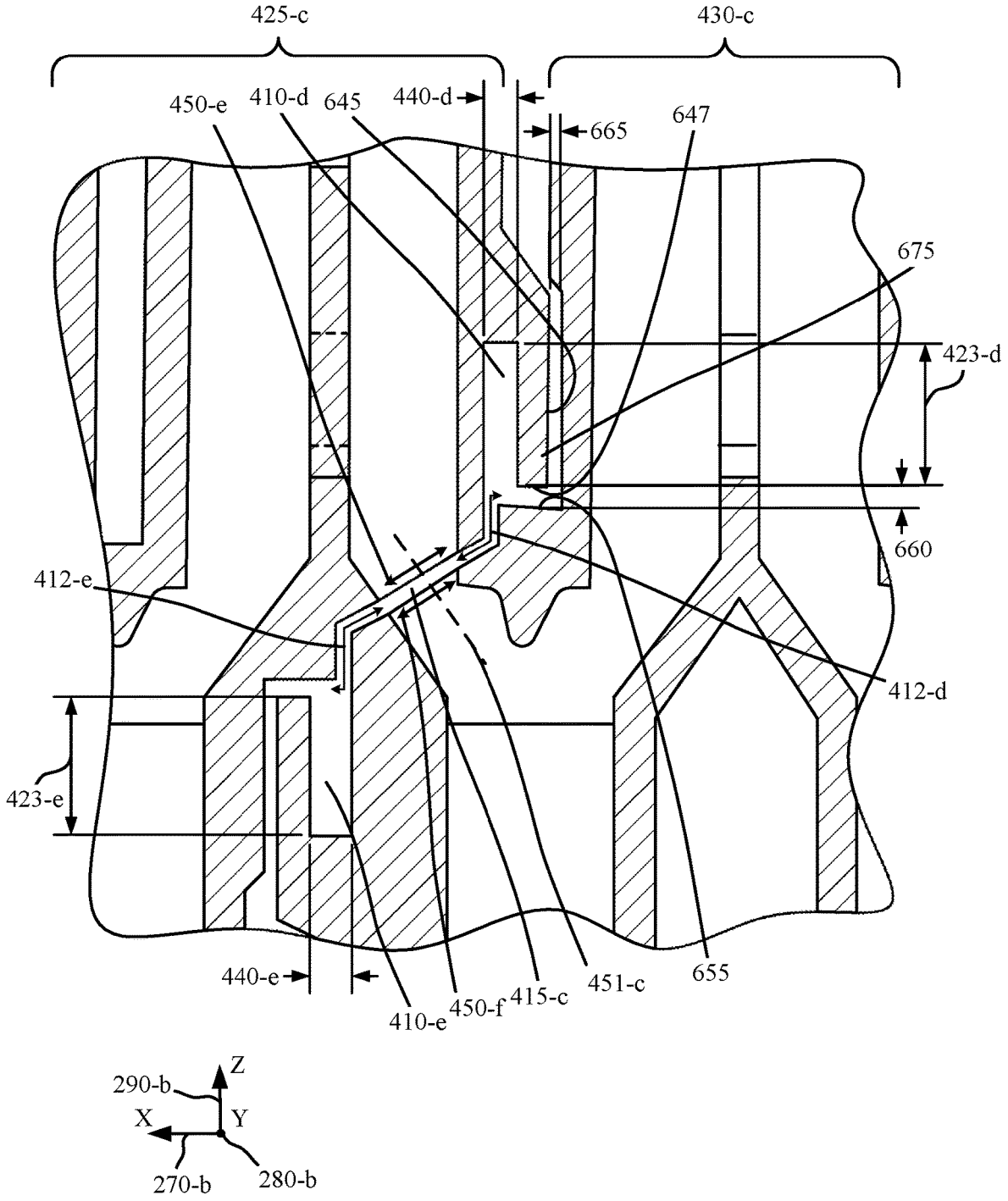
Figure 6C:
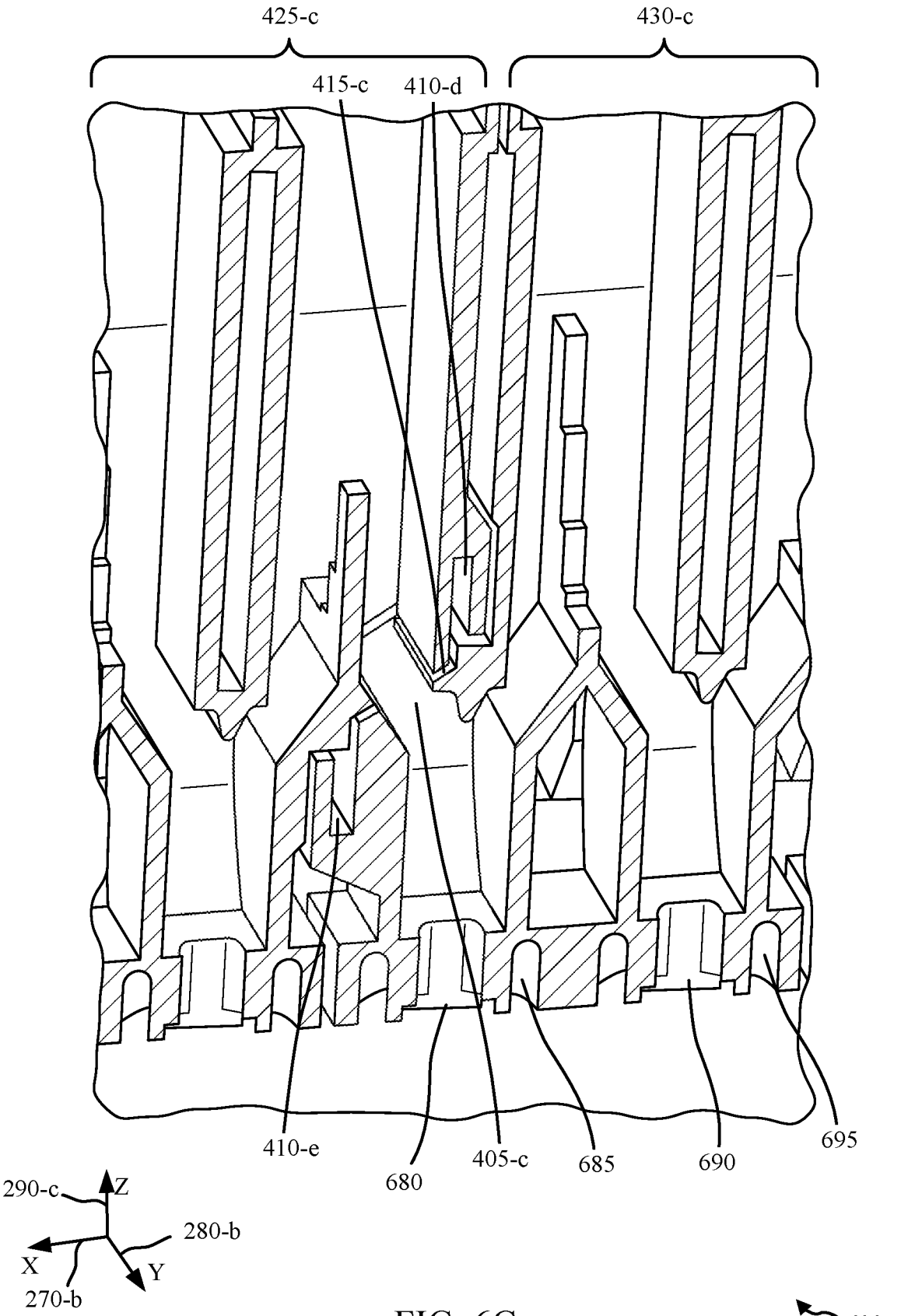

FIGS. 6A-6C show views 600 of an RF seal for a waveguide block interface in accordance with aspects of the present disclosure. The waveguide block interface may be an example of an interface between the waveguide blocks as described with reference to FIGS. 3A to 5B. Although the views of the waveguide block interface illustrate the interface for one waveguide, it should be understood that multiple and possible dozens or hundreds of waveguides may be joined at the waveguide block interface, as described above.

FIG. 6A shows a side view 600-*a* of a section plane of the RF seal for the waveguide block interface. The section plane is parallel to an axis orthogonal to the plane defined by a face of a first waveguide block 425-*c*, the face of the first waveguide block 425-*c* having an opening for a first portion of a waveguide 405-*c*, and the plane defined by a face of a second waveguide block 430-*c*, the face of the second waveguide block 430-*c* having an opening for a second portion of the waveguide 405-*c*. In the example shown in FIGS. 6A-6C, the waveguide 405-*c* may be a part of a feed network for divided waveguides 215-*b* of an antenna element 225-*b* as discussed with reference to FIGS. 2, 3A, and 3B. For example, the waveguide 405-*c* may couple divided waveguide 215-*b* with a combiner/divider that combines/divides additional divided waveguides 215-*b* and an intermediate waveguide 682 associated with the divided waveguides 215-*b*. As described above, it may be desirable to have relatively small inter-element spacing between adjacent antenna elements 225-*b* (e.g., less than one-half or one-quarter of a wavelength at an operational frequency of the waveguide device). The side view 600-*a* of the RF seal for the waveguide block interface is shown with reference to the X-axis 270-*b*, Y-axis 280-*b*, and Z-axis 290-*b*. In some cases, further waveguide blocks may be appended to the first waveguide block 425-*c* and the second waveguide block 430-*c* in a similar manner as described herein to form a large array of waveguide blocks.

As shown in FIG. 6A, dielectric gap 415-*c* is formed at the interface between the face 426-*c* of the first waveguide block 425-*c* and the face 431-*c* of the second waveguide block 430-*c*. The dielectric gap 415-*c* may be the dielectric gap (e.g., an air gap) as described with reference to FIGS. 3A to 5B. Arrow 620 may illustrate the E-plane dimension of waveguide 405-*c*, and, as shown in FIG. 6A, a portion of the dielectric gap 415-*c* may include E-plane bends. Channels 410-*d* and 410-*e* are also shown. The channel 410-*d* extends into the face 426-*c* of the first waveguide block 425-*c*, and the channel 410-*e* extends into the face 431-*c* of the second waveguide block 430-*c*. According to this design, channels 410-*d* and 410-*e* are on opposite sides of the dielectric gap 415-*c*. Alternatively, channels 410-*d* and 410-*e* may be formed within any combination of the first waveguide block 425-*c* and the second waveguide block 430-*c*, as described with reference to FIGS. 4A-5B. In some implementations, the channels 410 may form either partial RF chokes as described with reference to FIGS. 4A-4B, or alternatively the channels 410 may form a full RF choke as described with reference to FIGS. 5A-5B.

FIG. 6B illustrates the interface between the first waveguide block 425-*c* and the second waveguide block 430-*c* around the opening 450-*e* in the first waveguide block 425-*c* and the opening 450-*f* in the second waveguide block 430-*c* in more detail. As shown in FIG. 6B, a portion of dielectric gap 415-*c* extends for length 412-*d* along the face 426-*c* of the first waveguide block 425-*c* from the opening 450-*e* to the channel 410-*d*. For example, the first length 412-*d* may be one-quarter wavelength (or any integer multiple of one-quarter wavelength having an odd numerator such as three-quarters of the wavelength) with reference to an operational frequency of the waveguide device illustrated in FIGS. 6A-6C. Similarly, a portion of dielectric gap 415-*c* extends for length 412-*e* along the face 431-*c* of the second waveguide block 430-*c* from the opening 450-*f* to the channel 410-*e*. The length 412-*e* may also be one-quarter wavelength (or any integer multiple of one-quarter wavelength having an odd numerator such as three-quarters of the wavelength) with reference to an operational frequency of the waveguide device illustrated in FIGS. 6A-6C. The channel 410-*d* may have a depth shown by length 423-*d* and the channel 410-*e* may have a depth shown by length 423-*e*. The channels 410-*d* and 410-*e* may end in blind waveguide stubs. In some cases, the combined distance of length 412-*d* and length 423-*d* is one-half wavelength at an operational frequency of the waveguide device. Similarly, the combined distance of length 412-*e* and length 423-*e* may be one-half wavelength at an operational frequency of the waveguide device. Accordingly, after mating the face of the first waveguide block 425-*c* to the face of the second waveguide block 430-*c*, a half-wavelength stub may be formed on each side of the waveguide 405-*c* ending at the closed end of each of the channels 410. The half-wavelength stubs may be in the E-plane dimension of the waveguide 405-*c*. For example, a half-wavelength stub may be formed with the length 412-*d* of the dielectric gap 415-*c* between the waveguide 405-*c* and the quarter-wavelength channel 410-*d* on the face 426-*c* of the first waveguide block 425-*c* in combination with the length 423-*d* of the depth of channel 410-*d* itself. Similarly, a half-wavelength stub may be formed with the length 412-*e* of the dielectric gap 415-*c* between the waveguide 405-*c* and the quarter-wavelength channel 410-*e* on the face 431-*e* of the second waveguide block 430-*c* in combination with the length 423-*e* of the depth of 410-*e* itself. In some cases, the lengths 412-*d*, 412-*e*, 423-*d*, or 423-*e* may not each be exactly one-quarter wavelength. In some examples, the lengths 423-*d* and 423-*e* are longer than the lengths 412-*d* and 412-*e*. Thus, lengths 423-*d* and 423-*e* may be one-quarter wavelength plus a delta 6, and lengths 412-*d* and 412-*e* may be one-quarter wavelength minus delta 6. In addition, channels 410-*d* and 410-*e* may have a first dimension (e.g., H-plane dimension) equal to a dimension (e.g., H-plane dimension) of waveguide 405-*c* at openings 450-*e* and 450-*f*. Channel 410-*d* may have a second dimension given by width 440-*d*, and channel 410-*e* may have a second dimension given by width 440-*e*. Widths 440-*d* and 440-*e* may be less than a second dimension (e.g., E-plane dimension) of waveguide 405-*c* at openings 450-*e* and 450-*f*. Widths 440-*d* and 440-*e* may be equal, or, may be unequal, in some cases. Electromagnetic simulation may be used to fine-tune lengths 412, 423, and widths 440 given the geometry of the interface between the waveguide blocks 425-*c* and 430-*c* to optimize the impedance properties of the openings of the channels 410 or the waveguide stubs. In some examples, channels 410-*d* and 410-*e* may be open circuit channels. In these cases, the lengths 423-*d* or 423-3 may one-half wavelength (or any integer multiple of one-half wavelength).

The face 426-*c* of the first waveguide block 425-*c* and the face 431-*c* of the second waveguide block 430-*c* that are mated as shown in FIGS. 6A-6C may include multiple planar or substantially planar sections (e.g., as seen in the cross-section of FIGS. 6A and 6B). For example, the face 426-*c* of the first waveguide block 425-*c* may include a first planar section, a second planar section, and a third planar section (it should be understood that the sections may not be completely planar, but generally extend in a given plane). The third planar section includes the opening 450-*e* for the waveguide 405-*c*, with the first planar section extending generally in the Y-Z plane from the third planar section to the top of FIGS. 6A and 6B along the face, and the second planar section extending generally in the Y-Z plane from the third planar section to the bottom of FIGS. 6A and 6B along the face. The first planar section may be parallel to a wall of individual waveguide 215-*b* and the second planar section may be parallel to a wall of intermediate waveguide 682 of the waveguide device. For example, a direction of wave propagation in individual waveguides 210-*b* and 215-*b* and in intermediate waveguide 682 may generally be along the Z-axis 290-*b* (e.g., in a positive or negative direction), and the first and second planar sections may generally be parallel with the Z-axis 290-*b*. Accordingly, the first and third planar section, as shown in FIG. 6A, may define planes offset from each other along a dimension perpendicular to the first planar section. In some cases, the first planar section and the third planar section may, but need not, define parallel planes. The third planar section may be at an oblique angle to the first planar section or the third planar section. A center axis 451-*c* of the waveguide 405-*c* may be perpendicular to the third planar section at the openings 450-*e* and 450-*f*.

As shown in FIG. 6B, the first waveguide block 425-*c* may include a protrusion 675 with a first edge 645 and a second edge 647. The first edge 645 of the protrusion may be parallel to the first planar section (e.g., also in the Y-Z plane), and the second edge 647 of the protrusion may be non-parallel with the first planar section (e.g., in the X-Y plane) may house the channel 410-*d*. Opposite the protrusion 675, the second waveguide block 430-*c* may include a step 655 corresponding to the edges of the protrusion 675. As shown in FIG. 6B, a width 665 of the dielectric gap 415-*c* between the first edge 645 of the protrusion 675 and the face 431-*c* of the second waveguide block 430-*c* may be different from a width 660 of the dielectric gap 415-*c* between the second edge 647 of the protrusion of the first waveguide block and the step 655 of the second waveguide block 430-*c*. For example, the width 660 of the dielectric gap 415-*c* between the second edge 647 of the protrusion and the step 655 (e.g., in the direction of the Z-axis 290-*b*) may be greater than the width 665 of the dielectric gap 415-*c* in the direction of the X-axis 270-*b*. Although not labeled, the second waveguide block 430-*c* is illustrated with a similar protrusion housing channel 410-*e*. In some examples, protrusion(s) 675 may generally allow the channels 410 to be parallel to other waveguides (e.g., divided waveguides 210-*b* and 215-*b* or intermediate waveguide 682) of the waveguide device, which may, for example, allow a relatively small inter-element distance to be maintained. In addition, the protrusion(s) and/or steps 655 may allow a greater tolerance in the Z-axis 290-*b* than in either the X-axis 270-*b* or the Y-axis 280-*b*. This may be due to a method of manufacture that may have greater tolerances along one axis than another. For example, a 3D printing system may provide more precision in a lateral direction than in a vertical direction. In some examples, a contact region between the first waveguide block 425-*c* and the second waveguide block 430-*c* is defined at least partially by the first edge 645 of the protrusion 675 (e.g., the width 665 is designed to be zero). In addition, the second waveguide block 430-*c* may have a corresponding protrusion that houses the channel 410-*e*. The contact region may also be at least partially defined by a corresponding first edge of the protrusion of the second waveguide block 430-*c*. Having at least one contact region for the waveguide blocks defined by the protrusions may place the contact reference feature close to the openings 450-*e* and 450-*f* while ensuring that any shorting of the dielectric gap 415-*c* is on an opposite side of the channels 410-*d* and 410-*e* from the openings 450-*e* and 450-*f*. Thus, the effect of any manufacturing variation is not magnified by being a long distance from the openings 450-*a* and 450-*f*, while the effect of differences in contact along the contact region (e.g., in the Y-axis 280-*b*) are eliminated by the infinite (or almost infinite) impedance at the junction between the channels 410-*d* and 410-*e* and the dielectric gap 415-*c*.

FIG. 6C shows an isometric view 600-*c* of the RF seal for the waveguide block interface. The isometric view is rotated approximately 30° from the side view as described with reference to FIG. 6A. The isometric view 600-*c* of the RF seal for the waveguide block interface is shown with reference to the X-axis 270-*b*, Y-axis 280-*b*, and Z-axis 290-*b*. FIG. 6C shows that ports 680 associated with a first polarization of antenna elements 225 in a waveguide device for an antenna array may also have quarter-wavelength chokes 685 for interfacing with a feed network for further combining/dividing the waveguide network of the first polarization (e.g., combining/dividing for multiple ports 680). In addition, ports 690 associated with a second polarization of antenna elements 225 may also have quarter-wavelength chokes 695 for interfacing with the feed network for further combining/dividing the waveguide network of the second polarization (e.g., combining/dividing for multiple ports 690). The feed network may be, for example, the feed network 320 as shown in FIG. 3A and may generally extend in the X-Y plane (combining/dividing for ports 680 and 690 that are in different locations in the X-Y plane).

Figure 7:
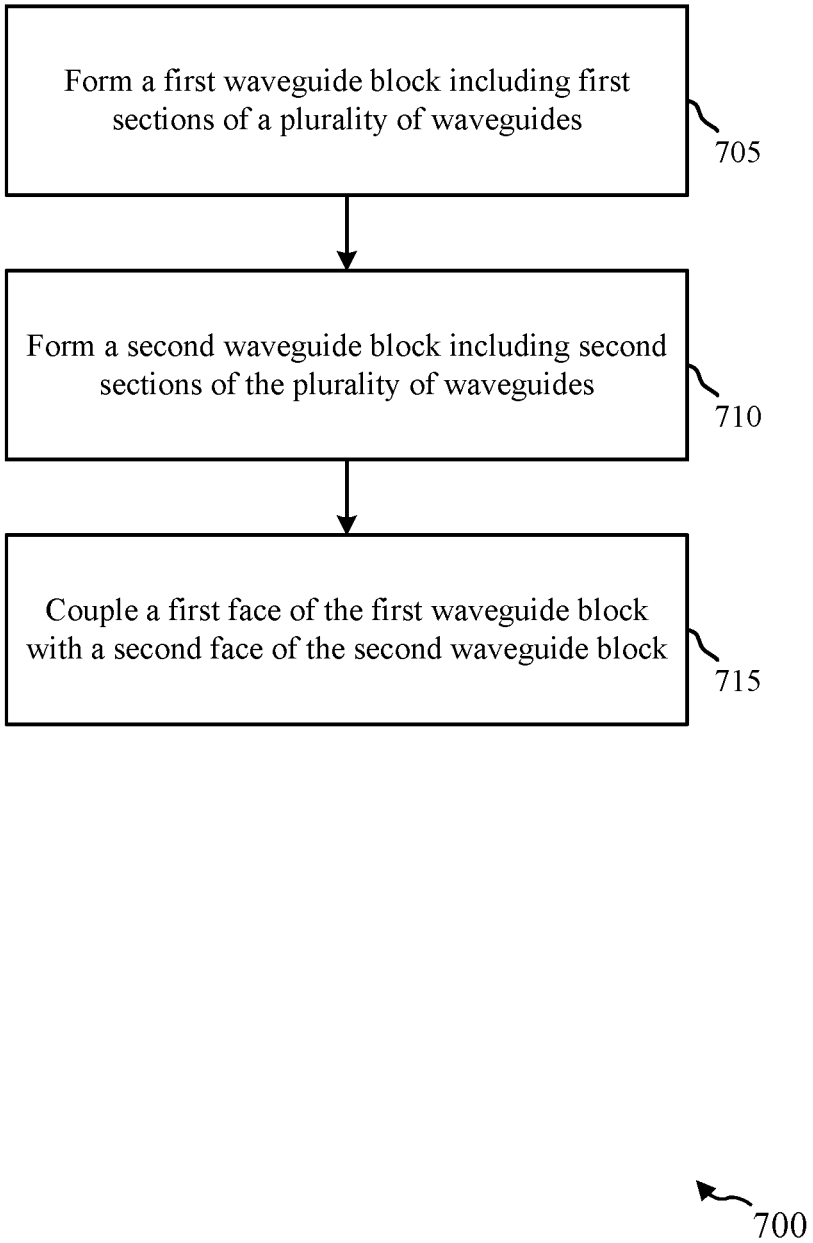
FIG. 7 shows a flowchart of an example method for manufacturing a RF seal for a waveguide block interface in accordance with aspects of the present disclosure.

FIG. 7 shows a flowchart of an example method 700 for manufacturing an RF seal for a waveguide block interface in accordance with aspects of the present disclosure. The method 700 may be used to create the waveguide blocks as described with references to FIGS. 3 to 6C. In some cases, the method 700 may be implemented via, for example 3D printing. In some cases, a processor may execute one or more sets of codes to control printing, plating, casting, molding, and/or machining equipment to perform the functions described below.

At 705, the method 700 may include forming a first waveguide block including first sections of a plurality of waveguides. The first waveguide block may include a first face having first openings for the first sections of the plurality of waveguides and a plurality of first channels. In some cases, the first face may include a first planar section and a second planar section, where the second planar section may be offset from the first planar section along a dimension perpendicular to the first planar section. In some cases, the first face may further include a third planar section between the respective first and second planar sections, and the first openings may be located on the third planar section of the first face. Each of the plurality of first channels may be located at a first length along the first face from one of the first openings. The plurality of first channels may extend into the first waveguide block a second length. In some cases, the first waveguide block may include a protrusion of the first planar section having a first edge parallel to the first planar section and a second edge that is non-parallel with the first planar section. The second edge of the protrusion may house the plurality of first channels. In some cases, the first waveguide block may be formed, at least in part, by additive manufacturing (e.g., 3D printing). In some cases, additively manufactured waveguide blocks (e.g., the first waveguide block) may include voids that are coated with a conductive coating to form the plurality of waveguides.

At 710, the method 700 may include forming a second waveguide block including second sections of the plurality of waveguides. The second waveguide block may have a second face comprising second openings for the second sections of the plurality of waveguides. In some cases, the second waveguide block may include a step corresponding to the second edge of the protrusion of the first waveguide block. In some cases, a width of the dielectric gaps between the first edge of the first waveguide block and the second waveguide block may be different from a width of the dielectric gaps between the second edge of the protrusion of the first waveguide block and the step of the second waveguide block. In some cases, the second waveguide block may be formed, at least in part, by additive manufacturing.

At 715, the method 700 may include coupling the first face of the first waveguide block with the second face of the second waveguide block. In some cases, the first portions of a plurality of first waveguide stubs may be formed by first portions of dielectric gaps between the first face and the second face extending for the first length, and second portions of the plurality of first waveguide stubs may be formed by the plurality of first channels. In some cases, the lengths of the plurality of first waveguide stubs may be based at least in part on an operational frequency of the plurality of waveguides.

The detailed description set forth above in connection with the appended drawings describes exemplary embodiments and does not represent the only embodiments that may be implemented or that are within the scope of the claims. The term "example" used throughout this description means "serving as an example, instance, or illustration," and not "preferred" or "advantageous over other embodiments." The detailed description includes specific details for the purpose of providing an understanding of the described techniques. These techniques, however, may be practiced without these specific details. In some instances, wellknown structures and devices are shown in block diagram form in order to avoid obscuring the concepts of the described embodiments.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The functions described herein may be implemented in various ways, with different materials, features, shapes, sizes, or the like. Other examples and implementations are within the scope of the disclosure and appended claims. Features implementing functions may also be physically located at various positions, including being distributed such that portions of functions are implemented at different physical locations. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

As used in the present disclosure, the term "parallel" is not intended to suggest a limitation to precise geometric parallelism. For instance, the term "parallel" as used in the present disclosure is intended to include typical deviations from geometric parallelism relating to such considerations as, for example, manufacturing and assembly tolerances. Further, certain manufacturing process such as molding or casting may require positive or negative drafting, edge chamfers and/or fillets, or other features to facilitate any of the manufacturing, assembly, or operation of various components, in which case certain surfaces may not be geometrically parallel, but may be parallel in the context of the present disclosure.

Similarly, as used in the present disclosure, the terms "orthogonal" and "perpendicular," when used to describe geometric relationships, are not intended to suggest a limitation to precise geometric perpendicularity. For instance, the terms "orthogonal" and "perpendicular" as used in the present disclosure are intended to include typical deviations from geometric perpendicularity relating to such considerations as, for example, manufacturing and assembly tolerances. Further, certain manufacturing process such as molding or casting may require positive or negative drafting, edge chamfers and/or fillets, or other features to facilitate any of the manufacturing, assembly, or operation of various components, in which case certain surfaces may not be geometrically perpendicular, but may be perpendicular in the context of the present disclosure.

As used in the present disclosure, the term "orthogonal," when used to describe electromagnetic polarizations, is meant to distinguish two polarizations that are separable. For instance, two linear polarizations that have unit vector directions that are separated by 90 degrees can be considered orthogonal. For circular polarizations, two polarizations are considered orthogonal when they share a direction of propagation, but are rotating in opposite directions.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the widest scope consistent with the principles and novel features disclosed herein.

What is claimed is:

1. A method of manufacturing a waveguide device, comprising:

forming a first waveguide block comprising first sections of a plurality of waveguides, the first waveguide block comprising:

a first face comprising first openings for the first sections of the plurality of waveguides; and a plurality of first channels, each of the plurality of first channels located at a first length along the first face from one of the first openings, the plurality of first channels extending into the first waveguide block a second length;

forming a second waveguide block comprising second sections of the plurality of waveguides, the second waveguide block comprising:

a second face comprising second openings for the second sections of the plurality of waveguides; and coupling the first face of the first waveguide block with the second face of the second waveguide block, wherein first portions of a plurality of first waveguide stubs are formed by first portions of dielectric gaps between the first face and the second face extending for the first length, and second portions of the plurality of first waveguide stubs are formed by the plurality of first channels, and wherein lengths of the plurality of first waveguide stubs are based at least in part on an operational frequency of the plurality of waveguides.

2. The method of manufacturing of claim 1, wherein a first impedance of the plurality of first waveguide stubs to the plurality of waveguides at each of the first openings is less than a wave impedance of the plurality of waveguides.

3. The method of manufacturing of claim 1, wherein:

the second waveguide block comprises a plurality of second channels, each of the plurality of second channels located at the first length along the second face from one of the second openings, the plurality of second channels extending into the second waveguide block the second length; and upon the coupling of the first face of the first waveguide block with the second face of the second waveguide block, first portions of a plurality of second waveguide stubs are formed by second portions of the dielectric gaps between the first face and the second face, the second portions of the dielectric gaps being the first length along the second face, and second portions of the plurality of second waveguide stubs are formed by the plurality of second channels, wherein lengths of the plurality of second waveguide stubs are based at least in part on the operational frequency of the plurality of waveguides.

4. The method of manufacturing of claim 3, wherein, upon the coupling of the first face of the first waveguide block with the second face of the second waveguide block, the plurality of first channels are located in a first direction along the first face and the plurality of second channels are located in a second direction along the second face, the first direction being opposite of the first openings from the second direction.

5. The method of manufacturing of claim 1, wherein the first openings for the first sections of the plurality of waveguides define planes perpendicular to respective center axes of the plurality of waveguides.

6. The method of manufacturing of claim 1, wherein each of the plurality of first channels has a first set of opposing walls that are parallel with each other, and wherein a first dimension of a cross section of each of the plurality of first channels in a transverse plane corresponds to a first dimension of the first openings.

7. The method of manufacturing of claim 6, wherein a second dimension of the cross section of each of the plurality of first channels in the transverse plane is less than a second dimension of the first openings.

8. The method of manufacturing of claim 1, wherein each of the plurality of first channels has a first set of opposing walls that are parallel with each other, and wherein the first set of opposing walls comprises a turn extending each of the plurality of first channels along more than one dimension of the first openings.

9. The method of manufacturing of claim 1, wherein each of the plurality of first channels encircles one of the first openings.

10. The method of manufacturing of claim 1, wherein second portions of the dielectric gaps extend away from the first openings along the first face from junctions of the first portions of the dielectric gaps with openings of the plurality of first channels.

11. The method of manufacturing of claim 1, wherein the first face comprises a first planar section and a second planar section, the second planar section being offset from the first planar section along a dimension perpendicular to the first planar section.

12. The method of manufacturing of claim 11, wherein:

the first face comprises a third planar section between the first and second planar sections, and the first openings are located on the third planar section of the first face.

13. The method of manufacturing of claim 11, wherein the first waveguide block comprises a protrusion on the first planar section having a first edge parallel to the first planar section and a second edge that is non-parallel with the first planar section, the second edge of the protrusion housing the plurality of first channels.

14. The method of manufacturing of claim 13, wherein the second waveguide block comprises a step corresponding to the second edge of the protrusion on the first waveguide block, and wherein a width of the dielectric gaps between the first edge of the first waveguide block and the second waveguide block is different from a width of the dielectric gaps between the second edge of the protrusion of the first waveguide block and the step of the second waveguide block.

15. The method of manufacturing of claim 1, wherein the first portions of the dielectric gaps comprise E-plane bends.

16. The method of manufacturing of claim 1, wherein an angle of at least one set of opposing walls of each of the plurality of first channels relative to the first face is other than ninety degrees.

17. The method of manufacturing of claim 1, wherein the lengths of the plurality of first waveguide stubs are one half-wavelength of the operational frequency of the plurality of waveguides.

18. The method of manufacturing of claim 1, wherein the plurality of first channels comprise blind waveguide stubs.

19. The method of manufacturing of claim 1, wherein the first length is one quarter-wavelength of the operational frequency of the plurality of waveguides.

20. The method of manufacturing of claim 1, wherein the second length is one quarter-wavelength of the operational frequency of the plurality of waveguides.

21. The method of manufacturing of claim 1, wherein at least one of the first or second waveguide blocks comprises a plurality of polarizers, the plurality of polarizers including an individual waveguide and first and second divided waveguides associated with first and second polarizations.

22. The method of manufacturing of claim 21, wherein each of the plurality of waveguides correspond to one of the first and second divided waveguides.

23. The method of manufacturing of claim 1, wherein the first waveguide block and the second waveguide block are formed at least in part by additive manufacturing.

24. The method of manufacturing of claim 23, wherein the additively manufactured first and second waveguide blocks comprise voids that are coated with a conductive coating to form the plurality of waveguides.

* * * * *